US009761081B2

(12) United States Patent
Barclay et al.

(10) Patent No.: US 9,761,081 B2
(45) Date of Patent: Sep. 12, 2017

(54) INTEGRATING VIDEO FEEDS AND WAGERING-GAME CONTENT

(71) Applicant: Bally Gaming, Inc., Las Vegas, NV (US)

(72) Inventors: Brian J. Barclay, Atlanta, GA (US); Andrew C. Guinn, Chicago, IL (US); Richard T. Schwartz, Deerfield, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 121 days.

(21) Appl. No.: 14/619,947

(22) Filed: Feb. 11, 2015

(65) Prior Publication Data

US 2015/0154823 A1 Jun. 4, 2015

Related U.S. Application Data

(63) Continuation of application No. 13/272,454, filed on Oct. 13, 2011, now abandoned.

(60) Provisional application No. 61/392,782, filed on Oct. 13, 2010.

(51) Int. Cl.
*G07F 17/32* (2006.01)
*G07F 17/34* (2006.01)

(52) U.S. Cl.
CPC ..... *G07F 17/3213* (2013.01); *G07F 17/34* (2013.01); *G07F 17/326* (2013.01)

(58) Field of Classification Search
CPC ..... G07F 17/3213
See application file for complete search history.

(56) References Cited

U.S. PATENT DOCUMENTS

| | | | |
|---|---|---|---|
| 6,287,199 | B1 | 9/2001 | McKeown et al. |
| 6,755,741 | B1 | 6/2004 | Rafaeli |
| 7,636,931 | B2 | 12/2009 | Gatto |
| 7,850,518 | B2 | 12/2010 | Walker et al. |

(Continued)

FOREIGN PATENT DOCUMENTS

| | | |
|---|---|---|
| GB | 2484594 | 4/2012 |
| JP | 2005073936 | 3/2005 |

(Continued)

OTHER PUBLICATIONS

"U.S. Appl. No. 13/797,551 Office Action", Jun. 16, 2016, 29 pages.

(Continued)

*Primary Examiner* — Jay Liddle
(74) *Attorney, Agent, or Firm* — DeLizio Law, PLLC

(57) ABSTRACT

A wagering game system and its operations are described herein. In some examples, the operations can include receiving a video feed of a casino wagering game presented live via a first device. The video feed depicts at least one first symbol from a set of wagering game symbols used for outcomes of the casino wagering game. The operations can further include, after receiving the video feed, compositing a computer-generated image with the video feed to generate a composited video feed. The image represents at least one second symbol from the set of wagering game symbols. The operations can further include providing the composited video feed for presentation of the casino wagering game via a second device separate from the first device.

21 Claims, 11 Drawing Sheets

(56) References Cited

U.S. PATENT DOCUMENTS

| | | | | |
|---|---|---|---|---|
| 7,956,926 | B2 | 6/2011 | Gatto et al. | |
| 8,012,021 | B2 | 9/2011 | Crowder, Jr. et al. | |
| 8,088,000 | B2 | 1/2012 | Ginsberg et al. | |
| 8,092,306 | B2 | 1/2012 | Root | |
| 8,152,641 | B2 | 4/2012 | Hill | |
| 8,221,230 | B2 | 7/2012 | Reeves | |
| 8,342,966 | B2 | 1/2013 | Storm et al. | |
| 2002/0068633 | A1 | 6/2002 | Schlaifer | |
| 2002/0183105 | A1 | 12/2002 | Cannon et al. | |
| 2003/0195043 | A1 | 10/2003 | Shinners et al. | |
| 2005/0020358 | A1* | 1/2005 | Cram | G07F 17/32 463/31 |
| 2006/0194633 | A1 | 8/2006 | Paulsen | |
| 2006/0217199 | A1 | 9/2006 | Adcox et al. | |
| 2006/0247031 | A1 | 11/2006 | Walker et al. | |
| 2007/0087804 | A1 | 4/2007 | Knowles et al. | |
| 2007/0117637 | A1 | 5/2007 | Morgan et al. | |
| 2007/0178955 | A1* | 8/2007 | Mills | A63F 1/00 463/13 |
| 2007/0267816 | A1 | 11/2007 | Goodman | |
| 2007/0293320 | A1 | 12/2007 | Nguyen et al. | |
| 2008/0020814 | A1 | 1/2008 | Kernene | |
| 2008/0026807 | A1* | 1/2008 | Moshal | G07F 17/32 463/16 |
| 2008/0070665 | A1 | 3/2008 | Gatto et al. | |
| 2008/0076548 | A1 | 3/2008 | Paulsen | |
| 2008/0194334 | A1 | 8/2008 | Kuok et al. | |
| 2008/0220849 | A1* | 9/2008 | Wadleigh | G07F 17/32 463/20 |
| 2009/0005165 | A1 | 1/2009 | Arezina et al. | |
| 2009/0054127 | A1 | 2/2009 | Sweary et al. | |
| 2009/0093292 | A1 | 4/2009 | Randhawa | |
| 2009/0118006 | A1* | 5/2009 | Kelly | A63F 3/00643 463/31 |
| 2009/0124329 | A1 | 5/2009 | Palmisano | |
| 2009/0258701 | A1 | 10/2009 | Crowder, Jr. et al. | |
| 2009/0291732 | A1* | 11/2009 | Lutnick | G07F 17/32 463/16 |
| 2010/0048288 | A1 | 2/2010 | Canterbury et al. | |
| 2010/0077422 | A1 | 3/2010 | Bushinsky | |
| 2010/0102511 | A1 | 4/2010 | Tammesoo | |
| 2010/0105464 | A1 | 4/2010 | Storm et al. | |
| 2010/0160012 | A1 | 6/2010 | Amaitis et al. | |
| 2010/0222140 | A1 | 9/2010 | Dewaal | |
| 2010/0227690 | A1 | 9/2010 | Brunet De Courssou et al. | |
| 2011/0028207 | A1 | 2/2011 | Gagner et al. | |
| 2011/0065496 | A1* | 3/2011 | Gagner | G07F 17/3209 463/25 |
| 2011/0079959 | A1* | 4/2011 | Hartley | G07F 17/32 273/292 |
| 2011/0143830 | A1 | 6/2011 | Fine | |
| 2011/0201414 | A1 | 8/2011 | Barclay et al. | |
| 2012/0094737 | A1 | 4/2012 | Barclay et al. | |
| 2013/0281188 | A1 | 10/2013 | Guinn et al. | |
| 2014/0148251 | A1 | 5/2014 | Nordahl et al. | |
| 2014/0370958 | A1* | 12/2014 | Lutnick | G07F 17/3276 463/17 |

FOREIGN PATENT DOCUMENTS

| | | |
|---|---|---|
| WO | 0227675 | 4/2002 |
| WO | 2007006083 | 1/2007 |
| WO | 2008039848 | 4/2008 |
| WO | 2010101813 | 9/2010 |

OTHER PUBLICATIONS

"U.S. Appl. No. 13/797,551 Final Office Action", Jul. 2, 2015, 18 Pages.
"UK Application No. 1117674.0 Search Report", Feb. 13, 2012, 5 pages.
"U.S. Appl. No. 13/272,454 Office Action", Oct. 31, 2014, 22 Pages.
"U.S. Appl. No. 13/272,454 Final Office Action", May 16, 2013, 17 pages.
"U.S. Appl. No. 13/272,454 Office Action", Jan. 16, 2013, 19 pages.
"U.S. Appl. No. 13/797,551 Office Action", Jan. 16, 2015, 17 Pages.
"Wagering Limits", GamblersPalace.com, Feb. 29, 2008, 2 pages.
Co-pending U.S. Appl. No. 13/797,551, filed Mar. 12, 2013, 44 pages.
Co-pending U.S. Appl. No. 13/272,454, filed Oct. 13, 2011, 57 pages.
"U.S. Appl. No. 13/797,551 Final Office Action", Jan. 26, 2017, 30 pages.

* cited by examiner

INTEGRATING VIDEO FEEDS AND WAGERING-GAME CONTENT

RELATED APPLICATIONS

This application is a continuation application that claims priority benefit of U.S. application Ser. No. 13/272,454 filed Oct. 13, 2011 which claims benefit of U.S. Provisional Application Ser. No. 61/392,782 filed Oct. 13, 2010. The Ser. No. 13/272,454 Application and the 61/392,782 Application are incorporated herein by reference.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2015, WMS Gaming, Inc.

TECHNICAL FIELD

Embodiments of the inventive subject matter relate generally to wagering game systems and networks that, more particularly, integrate video feeds and wagering-game content.

BACKGROUND

Wagering game machines, such as slot machines, video poker machines and the like, have been a cornerstone of the gaming industry for several years. Traditionally, wagering game machines have been confined to physical buildings, like casinos (e.g., resort casinos, road-side casinos, etc.). The casinos are located in specific geographic locations that are authorized to present wagering games to casino patrons. However, with the proliferation of interest and use of the Internet, shrewd wagering game manufacturers have recognized that a global public network, such as the Internet, can reach to various locations of the world that have been authorized to present wagering games. Any individual with a personal computing device (e.g., a personal computer, a laptop, a personal digital assistant, a cell phone, etc.) can connect to the Internet and play wagering games. Consequently, some wagering game manufacturers have created wagering games that can be processed by personal computing devices and offered via online casino websites ("online casinos"). However, online casinos face challenges and struggles. For instance, online casinos have struggled to provide the excitement and entertainment that a real-world casino environment provides. Some online casinos have struggled enforcing cross jurisdictional restrictions and requirements. Further, some online casinos have struggled adapting the online gaming industry to a traditionally non-wagering game business environment. As a result, wagering game manufacturers, casino operators, and online game providers are constantly in need of innovative concepts that can make the online gaming industry appealing and profitable.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into six sections. The first section provides an introduction to embodiments. The second section describes example operating environments while the third section describes example operations performed by some embodiments. The fourth section describes additional example embodiments while the fifth section describes additional example operating environments. The sixth section presents some general comments.

INTRODUCTION

This section provides an introduction to some embodiments.

Figure 1:
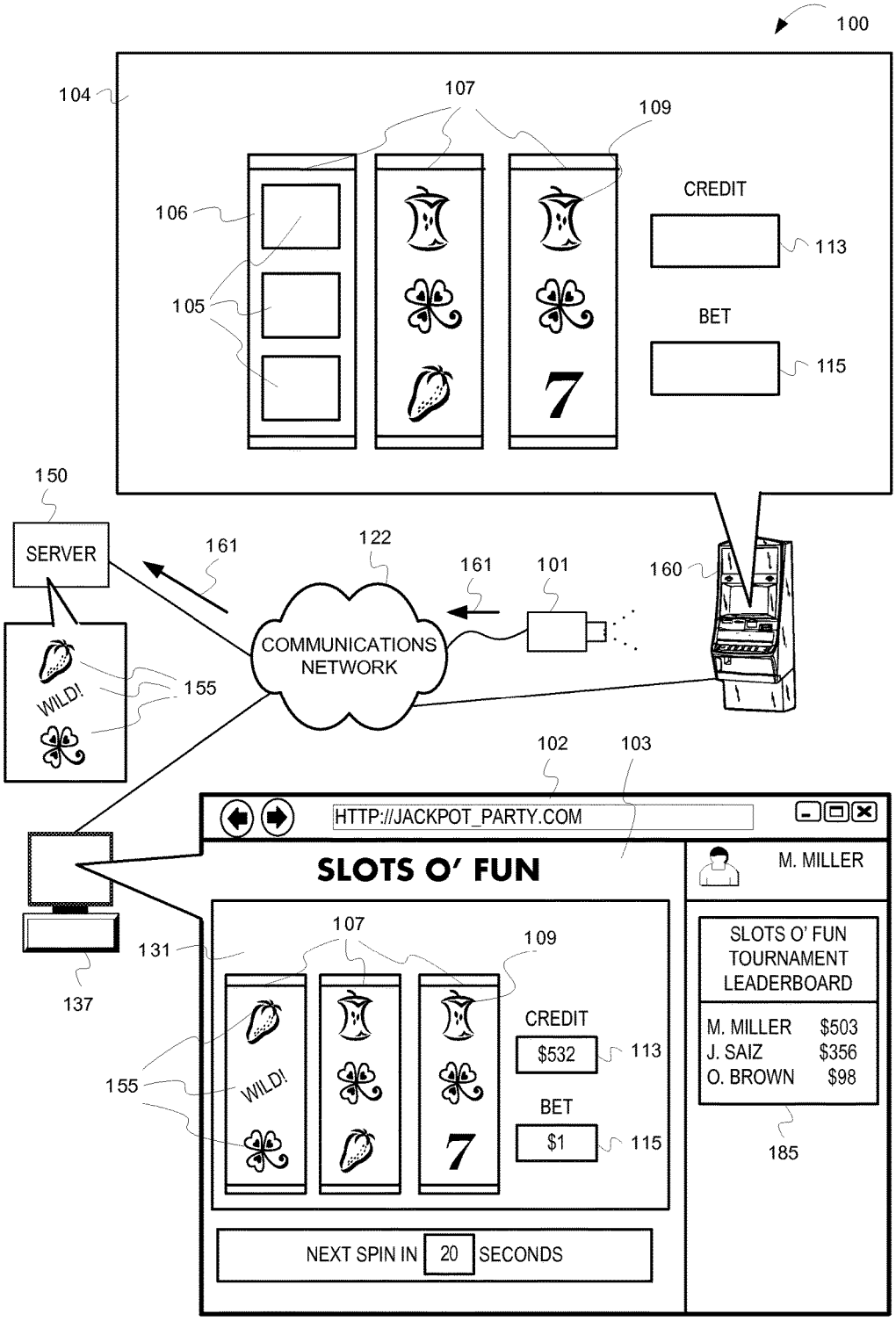
FIG. 1 is an illustration of integrating video of a wagering game from a wagering game machine into a wagering game webpage, according to some embodiments.

Wagering game providers constantly create a variety of fun and interesting wagering games. Those wagering games present wagering game content (e.g., background images, wagering game elements, animations, reel images, game characters, etc.) to engage the wagering game player's interest. The wagering game content has traditionally been restricted to simple content files (e.g., static images, game animations, etc.) that can be stored and accessed locally on a casino network. However, as wagering game machines and servers become more powerful in their ability to process and utilize all kinds of information, wagering game providers are discovering new ways to expand potential sources of wagering game content. FIG. 1 shows a wagering game system that can integrate wagering game content with video feeds (e.g., television broadcasts, closed-circuit recordings, etc.).

FIG. 1 is a conceptual diagram that illustrates an example of integrating video of a wagering game from a wagering game machine into a wagering game webpage, according to some embodiments. In FIG. 1, a wagering game system ("system") 100 includes a computer 137 connected to a server 150 via a communications network 122. Also included in the system 100 are a wagering game machine 160 and a video recording device, such as a video camera 101. The video camera 101 captures video images and generates a video feed 161 of a display 104 of the wagering game machine 160. The display 104 includes some items that would normally appear on a wagering game machine, such as slot reels (e.g., mechanical slot reels 107). Each of the mechanical slot reels ("reels") 107 can spin when activated by a lever, a button, or other player-activated control. The reels 107 (e.g., reel 106 or others of the reels 107) also include one or more portions 105 that are blank. The portions 105 are parts of the reels 107 on which wagering game elements would normally appear, such as reel symbols, but the portions 105 lack the wagering game elements. The camera 101 makes a video recording of the display 104 and transmits the video recording as the video feed 161. The video recording includes images of the portions 105 that are blank. The camera 101 provides the video feed 161, or stream of the video recording, to the server 150. The server 150 receives the video feed 161 and generates images of wagering game elements 155 (e.g., randomly selects pictures of reel symbols). The server 150 composites the images of the wagering game elements 155 with the video feed 161 so that the images of the wagering game elements 155 are presented on locations, or positions, of video frames of the video feed 161 that coincide with locations of the portions 105 of the reels 107. The portions 105 include material that has a consistent color and/or texture so that the server can perform an image compositing procedure, such as chroma key compositing, graphical layering, etc. Chroma key compositing (also known as chroma keying) is a technique for compositing two images (e.g., video frames) together in which a color (or a small color range) from one image is removed (or made transparent), revealing another image behind it. This technique is also referred to as color keying, color-separation overlay, greenscreen, and bluescreen.

In some embodiments, only some of the portions 105 are blank. In some embodiments, some of the reels 107 may include one or more wagering game elements 109 presented on (e.g., fastened to, projected onto, etc.) the reels 107, which the video camera 101 may record and provide to the server 150 in the video feed 161. The server 150 can generate the images of wagering game elements 155 for the blank portions 105 in a way that is customized only for one wagering game player account ("player account") that is logged in to a wagering game website or web service. For example, a player (e.g., the user named "M. Miller") can use the computer 137 and provide user input that launches a web browser application ("browser") 102 and which presents a webpage 103 of a wagering game website (e.g., "Jackpot Party.com"). The webpage 103 can present wagering game content for a wagering game session via various web-enabled technologies, code, objects, applications, metadata, etc. including, but not limited to hypertext markup language (HTML), JavaScript, AJAX, cascading style sheets, client-side scripts, extensible markup language (XML), Flash media players, video and audio players, applets, graphics, etc. The webpage 103 presents, as the wagering game content, a composite image 131 of the video feed 161 combined with the images of the wagering game elements 155. The composite image 131 can be static, dynamic, streaming, etc., and can include graphics, video, audio, or other forms of media content or multimedia content. The composite image 131 can include a presentation of the video feed 161, which includes streaming video images of the wagering game elements 109, the reels 107, and other elements on the display 104, such as a credit meter box 113 and a bet meter box 115. The credit meter box 113 and the bet meter box 115 can also be blank. The server 150 can generate other graphical images that represent a credit balance and a bet value that the server 150 can also composite with the video feed 161 in the credit meter box 113 and the bet meter box 115. The credit balance and the bet value can be customized, or made specific, to the player account that is logged on. For example, the player account may have a balance of "$532" and may select a "$1" denomination value for the slot game depicted by the webpage 103. The server 150 can generate graphics of the "$532" credit balance amount and the "$1" denomination amount and present those values, respectively, in the composite image 131 of the credit meter box 113 and the bet meter box 115.

As the reels 107 spin, the server 150 can cause the images of the wagering game elements 155 to change shape, size, color, shading, etc. so that the images of the wagering game elements 155 appear to move in a way that coincides with the movement of the reels 107. For example, the server 150 can cause the appearance of the images of the wagering game elements 155 to appear to roll behind the reels 107 and disappear from view in a similar way that the wagering game elements 109 roll being the reels 107 and disappear from view while the reels 107 spin. Further, the server 150 can modify the appearance of the images of the wagering game elements 155 to appear to have graphical distortion (e.g., noise, blurring, etc.) so that the images of the wagering game elements 155 appear to actually be on the reels 107.

In some embodiments, all of the wagering game elements on the reels 107 are recorded by the camera 101 and the system can generate images of replacement wagering game graphics on the images of the video recorded wagering game elements. Thus, the system 100 can provide a real-life depiction of a video recorded wagering game with images that are customized to a player account associated with a wagering game website.

Further, some embodiments of the inventive subject matter describe examples of integrating video feeds and wagering-game web content in a network wagering venue (e.g., an online casino, a wagering game website, a wagering network, etc.) using a communication network, such as the communications network 122 in FIG. 1. Embodiments can be presented over any type of communications network that provides access to wagering games, such as a public network (e.g., a public wide-area-network, such as the Internet), a private network (e.g., a private local-area-network gaming network), a file sharing network, a social network, a cell phone network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, in some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
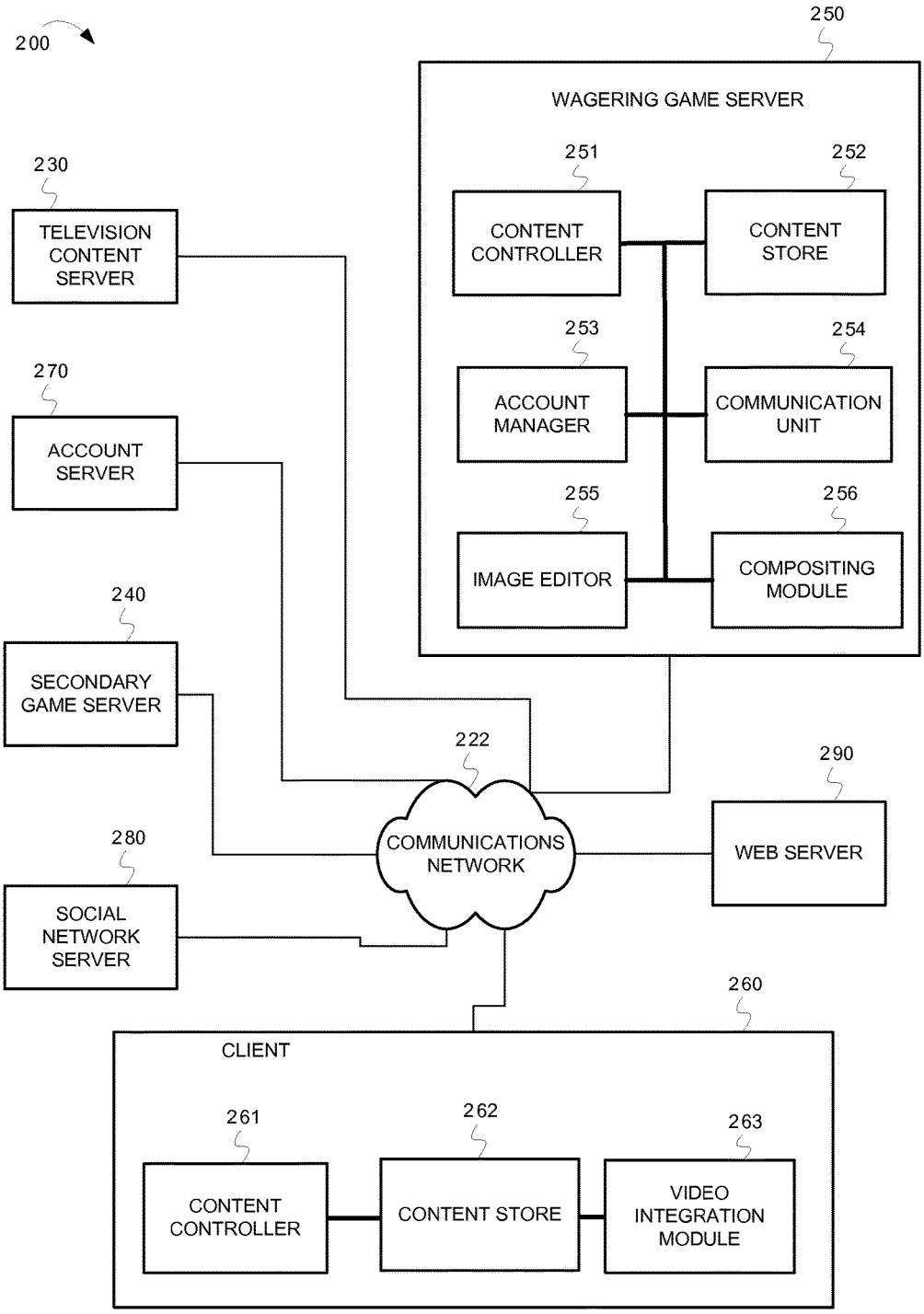
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networking networks. The account server 270 can store wagering game player account information, such as account settings (e.g., settings related to group games, settings related to social contacts, etc.), preferences (e.g., player preferences regarding video feeds), player profile data (e.g., name, avatar, screen name, etc.), and other information for a player's account (e.g., financial information, account identification numbers, virtual assets, social contact information, etc.). The account server 270 can contain lists of social contacts referenced by a player account. The account server 270 can also provide auditing capabilities, according to regulatory rules. The account server 270 can also track performance of players, machines, and servers.

The wagering game system architecture 200 can also include a wagering game server 250 configured to control wagering game content, provide random numbers, and communicate wagering game information, account information, and other information to and from the client 260. The wagering game server 250 can include a content controller 251 configured to manage and control content for the presentation of content on the client 260. For example, the content controller 251 can generate game results (e.g., win/loss values), including win amounts, for games played on the client 260. The content controller 251 can communicate the game results to the client 260. The content controller 251 can also generate random numbers and provide them to the client 260 so that the client 260 can generate game results. The wagering game server 250 can also include a content store 252 configured to contain content to present on the client 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the client 260 and to communicate with other systems, devices and networks. The wagering game server 250 can also include an image editor 255 configured to generate graphics, video, or other images that can be composited with live video feeds. The wagering game server 250 also can include a compositing module 256 configured to composite the graphics, images, video, etc. with video data from video feeds. The compositing module 256 can analyze activity that occurs in a video feed and generate wagering game elements and scenarios that can be used for those activities. The compositing module 256 can also be configured to digitize audio and video feeds into web-enabled media, composite the web-enable media with graphics and other web content, and embed the web-enabled media in a webpage.

The wagering game system architecture 200 can also include a client 260 configured to present wagering games and receive and transmit information to integrate video feeds and wagering-game websites. The client 260 can be a computer system, a personal digital assistant (PDA), a cell phone, a laptop, a wagering game machine, or any other device or machine that is capable of processing information, instructions, or other data provided via the communications network 222. The client 260 can include a content controller 261 configured to manage and control content and presentation of content on the client 260. The client 260 can also include a content store 262 configured to contain content to present on the client 260. The client 260 can also include a video integration module 263 configured to process communications, commands, or other information, where the processing can integrate video feeds and wagering content for wagering game websites. The video integration module 263 can perform any function that any other system component can perform regarding compositing and/or presenting composited video, graphics, images, etc. The video integration module 263 can also or process data and control information provided by any of the other system components.

The wagering game system architecture 200 can also include a web server 290 configured to control and present an online website that hosts wagering games. The web server 290 can also be configured to present multiple wagering game applications on the client 260 via a wagering game website, or other gaming-type venue accessible via the Internet. The web server 290 can host an online wagering website and/or a social networking website. The web server 290 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The web server 290 can also provide live streaming media, with video, audio, etc. integrated with wagering game content via a wagering game website.

The wagering game system architecture 200 can also include a secondary content server 240 configured to provide content and control information for secondary games and other secondary content available on a wagering game network (e.g., secondary wagering game content, promotions content, advertising content, player tracking content, web content, etc.). The secondary content server 240 can provide "secondary" content, or content for "secondary" games presented on the client 260. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. In some embodiments, the secondary content server 240 can provide and control content for community games, including networked games, social games, competitive games, or any other game that multiple players can participate in at the same time. In some embodiments, the secondary content server 240 can control and present an online website that hosts wagering games. The secondary content server 240 can also be configured to present multiple wagering game applications on the client 260 via a wagering game website, or other gaming-type venue accessible via the Internet. The secondary content server 240 can host an online wagering website and/or a social networking website. The secondary content server 240 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The secondary content server 240 can also be configured to integrate secondary content with video feeds. The secondary content server 240 can also provide chat functionality for a social networking website, a chat application, or any other social networking communications mechanism. In some embodiments, the secondary content server 240 can utilize player data to determine marketing promotions that may be of interest to a player account. The secondary content server 240 can also analyze player data and generate analytics for players, group players into demographics, integrate with third party marketing services and devices, etc. The secondary content server 240 can also provide player data to third parties that can use the player data for marketing. The secondary content server 240 can also provide and control content for community games, including networked games, social games, competitive games, or any other game that multiple players can participate in at the same time.

The wagering game system architecture 200 can also include a social network server 280 configured to host social network accounts, provide social networking content, control social networking communications, store associated social contacts, etc.

The wagering game system architecture 200 can also include a television content server 230 configured to provide and control television content and communications via television broadcasts, such as televised shows, sporting events, etc.

Each component shown in the wagering game system architecture 200 is shown as a separate and distinct element connected via a communications network 222. However, some functions performed by one component could be performed by other components. For example, the wagering game server 250 can also be configured to perform functions of the account server 270, the web server 290, the secondary content server 240, and other network elements and/or system devices. Furthermore, the components shown may all be contained in one device, but some, or all, may be included in, or performed by, multiple devices, as in the configurations shown in FIG. 2 or other configurations not shown. For example, the account manager 253 can be included in the client 260 instead of, or in addition to, being a part of the wagering game server 250. Further, in some embodiments, the client 260 can determine wagering game outcomes, generate random numbers, etc. instead of, or in addition to, the wagering game server 250.

As mentioned previously, in some embodiments, the client 260 can take the form of a wagering game machine. Examples of wagering game machines can include floor standing models, handheld mobile units, bar-top models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, clients and wagering game servers work together such that clients can be operated as thin, thick, or intermediate clients. For example, one or more elements of game play may be controlled by the client or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the clients can present a graphical representation of such outcome or asset modification to the user (e.g., player). In a thick-client example, the clients can determine game outcomes and communicate the outcomes to the wagering game server for recording or managing a player's account.

In some embodiments, either the client or the wagering game server(s) can provide functionality that is not directly related to game play. For example, account transactions and account rules may be managed centrally (e.g., by the wagering game server(s)) or locally (e.g., by the client). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
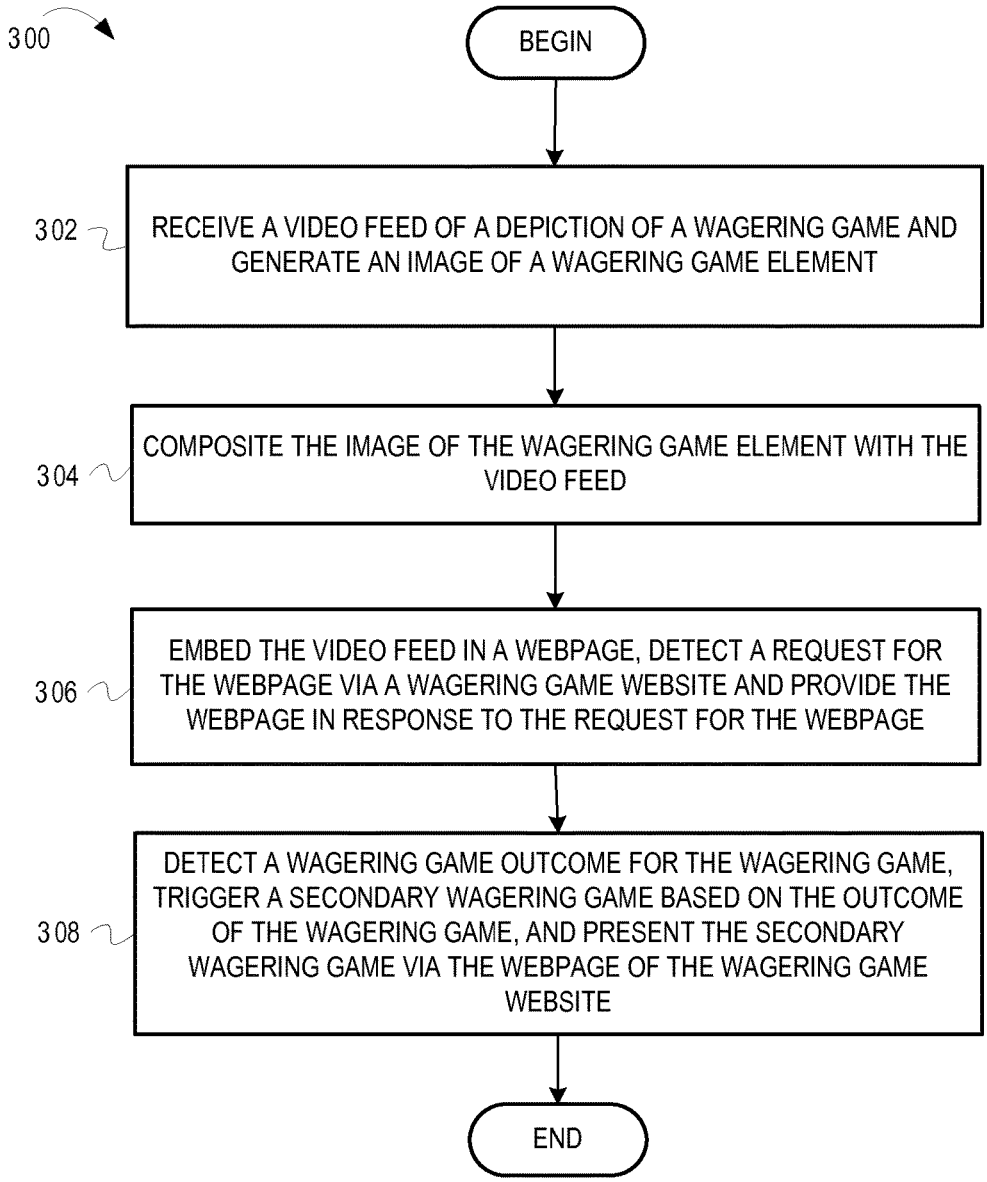
FIG. 3 is a flow diagram 300 illustrating integrating video of a wagering game into a wagering game website, according to some embodiments.

FIG. 3 is a flow diagram ("flow") 300 illustrating integrating video of a wagering game into a wagering game website, according to some embodiments. FIG. 1 helps illustrate the flow of FIG. 3, according to some embodiments. This description will present FIG. 3 in concert with FIG. 1. In FIG. 3, the flow 300 begins at processing block 302, where a wagering game system ("system") receives a video feed of a depiction of a wagering game and generates an image of a wagering game element. For instance, FIG. 1 above describes an example where the wagering game server 150 receives the video feed 161. The video feed 161 comes from the video camera 101. The video camera 101 can be in a casino, a studio, or any other location that provides live wagering games and game content that can be video recorded. In other embodiments the video feed 161 can come from other sources, such as from television broadcast studios, Internet media providers, etc. Referring again to FIG. 3, in some embodiments, the system captures video of physical objects involved in wagering games such as roulette wheels, poker tables, bingo cards, wagering game machines, etc. In some embodiments, the system generates graphics or animations. For instance, in FIG. 1, the system 100 generates the images of the wagering game elements 155. The images of the wagering game elements 155 may be photographs of reel symbols, computer generated images of reel symbols, etc.

The flow 300 continues at processing block 304, where the system composites the image of the wagering game element with the video feed. The system composites two or more images together into one image or into the appearance of one image. The system can utilize various types of image compositing. For instance, the system can digitize audio and video feeds into streaming media and composite the streaming media with graphics and other web content. In some embodiments, the system can overlay or superimpose images in layers. In another example, the system can chroma key composite images. In some embodiments, the system can modify an appearance of images such as a size, shape, color, etc. to conform to the appearance of other images (e.g., in FIG. 1, the server 150 causes the images of the images of wagering game elements 155 to conform to a shape and movement of the reels 107 as the reels 107 spin). In some embodiments, the system can provide graphical manipulation, such as performing graphical editing (e.g., adding distortion, adding blur, changing lighting and contrast, etc.). In some embodiments, the system can composite images by detecting a location in a video as a reference point and combining images automatically using the reference point (e.g., detect a border of a video frame and composite images onto the video in relation to the border). The system can detect the location by analyzing a boundary, a border, a dimension, a resolution, a contrast, a movement, or other characteristic about the video imagery.

In some embodiments, the image of the wagering game element may be a picture or another video image, such as a webcam media stream or a television broadcast. In some embodiments, similarly as shown in FIG. 1, the system can composite video of a wagering game machine with one or more additional images. The wagering game machine can present various types of wagering games. One type of wagering game is a slot game. In some embodiments, the wagering game machine can include a video screen with cutouts. Mechanical reels can be situated behind the video screen, but visible through the cutouts. Video images of reel symbols can be transmitted or projected onto projector-screen material that covers the reels. The reels can spin and produce a reel-stop combination. Symbols on the mechanical reels can occasionally interact with themed video images presented on the screen outside the cut-out region. The system can capture video of any or all of the mechanical reels, the video screen, the projections of symbols, etc. and composite additional images, such as images of a specific symbols, credit balances, etc. that are specific to a player account (e.g., see FIG. 1). In some embodiments, the system can capture images of blank elements and can composite themed images, wagering game elements, etc. onto the blank elements.

The flow 300 continues at processing block 306, where the system embeds the video feed in a webpage, detects a request for the webpage via a wagering game website and provides the webpage in response to the request of the webpage. The system can digitize video feeds, with audio, into web-enabled content, and embed the web-enabled content into a webpage to present as streaming media via the webpage.

The flow 300 continues at processing block 308, where the system detects a wagering game outcome for the wagering game, triggers a secondary wagering game based on the outcome of the wagering game, and presents the secondary wagering game via the webpage of the wagering game website. In FIG. 1, for example, the system 100 can detect an activation of the wagering game causing the reels 107 to spin. In some embodiments, the activation of the spin is performed via input not associated with the player account. In other words, an operator at the wagering game machine 160, or a command from the server 150 can cause the reels 107 to spin. Because the video feed of the display 104 of the wagering game machine 160 is presented to multiple players logged in to the wagering game website, the webpage 103 may not have a "spin" activation button. Instead, the reels 107 can be scheduled to spin periodically (e.g., every few seconds). Any given player can specify which spins the player would like to wager on. For instance, a player can specify a certain number of spins to wager on (e.g., the next 50 spins), set a certain pattern (e.g., wager on every other spin), set a time limit (e.g., wager on every spin for 5 minutes), some combination, etc. The wagering game server 150 can generate a random wagering game outcome for the wagering game and use the images of the wagering game elements 155 to present a wagering game outcome for the slot game. The wagering game server 150 can determine that the random wagering game outcome results in a winning result. The wagering game server 150 can reward a wager in response to determining that the random wagering game outcome results in a winning result. Further, the system 100 can present a bonus game, or other secondary wagering game content, in response to a specific wagering game outcome.

Returning to the discussion of FIG. 3, the system can detect characteristics about a player logged in to the website and/or the player account that the player uses. Some of the characteristics can include player status, player statistics, player wager history, etc. The system can select the wagering game player account to participate in the secondary wagering game based on the characteristics. In some embodiments, the system can be selective in the number of players to which the bonus game is presented. For example, the system can present the bonus game only to player accounts that received a winning outcome. In some embodiments, the system can present the secondary wagering game on the webpage for only one player account and not for any other player account associated with the wagering game website. In some embodiments, the system can present, within a browser, multiple different media streams that include depictions of video feeds. When a bonus event is about to occur in one of the media streams, the browser can notify a user which of the media streams will show the bonus event (e.g., audible notification, visual notification that causes a browser window to expand or highlight, etc.).

Figure 4:
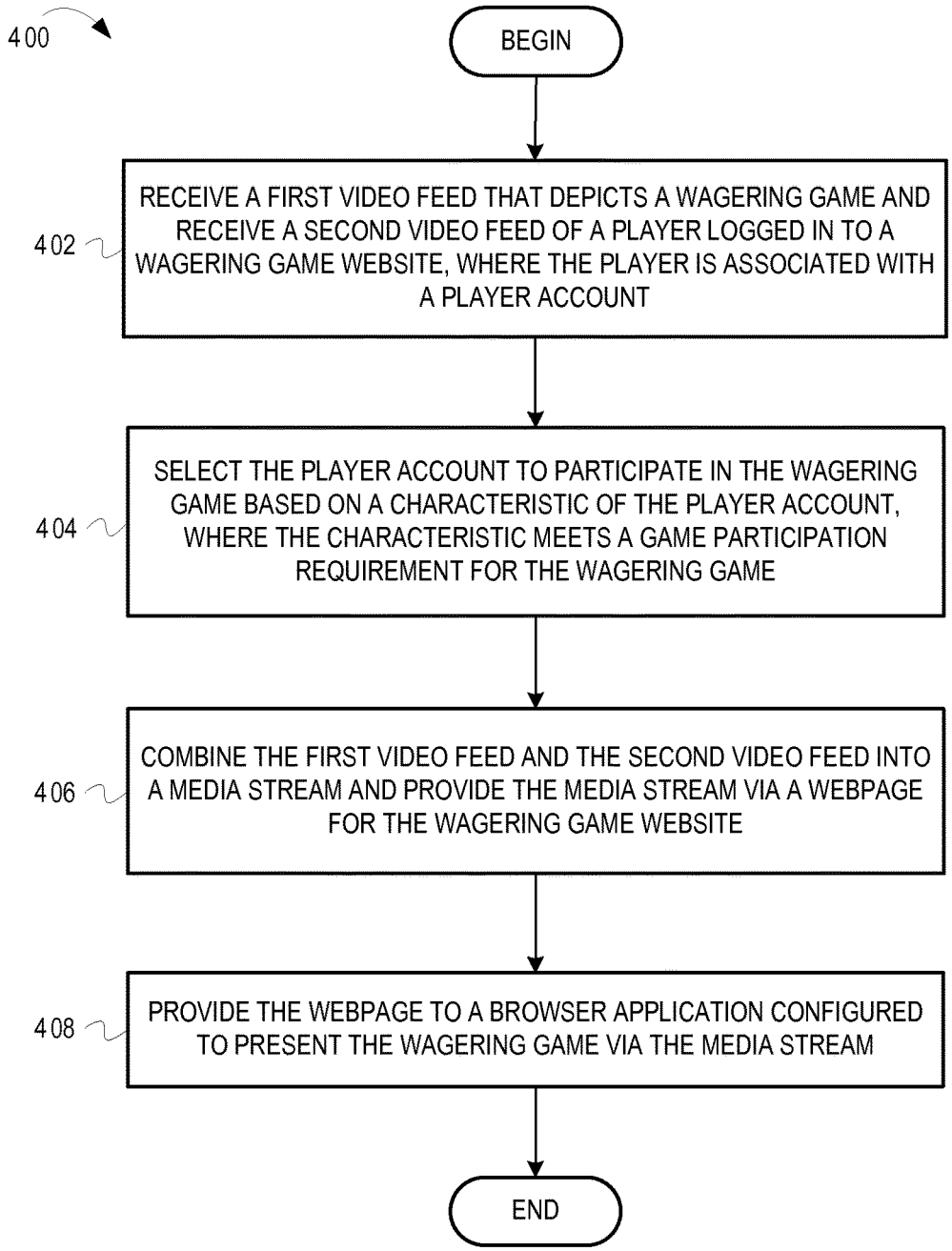
FIG. 4 is a flow diagram 400 illustrating integrating wagering content video feeds and web content, according to some embodiments.
Figure 5:
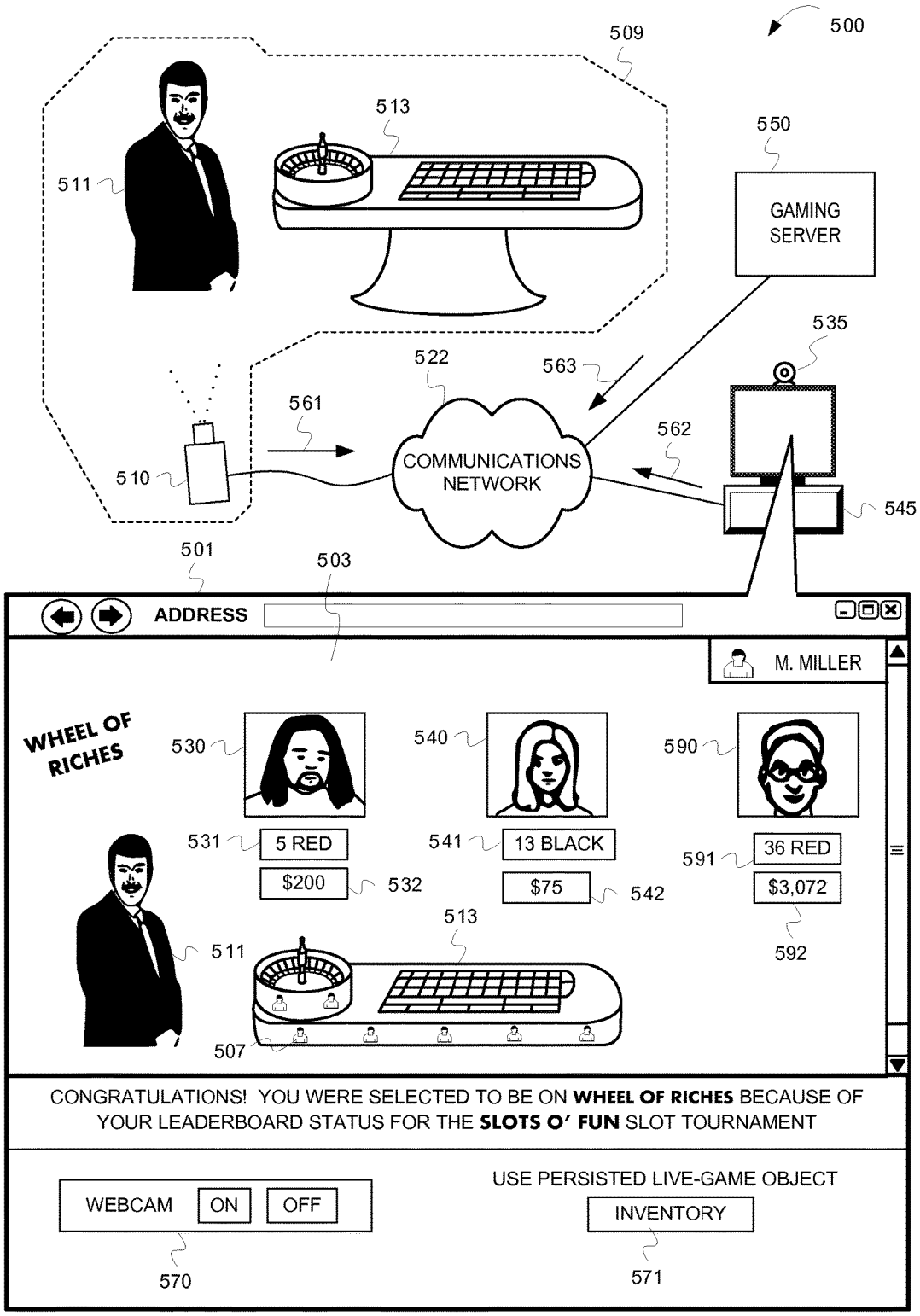
FIG. 5 is an illustration of a wagering game system 500, according to some embodiments.

FIG. 4 is a flow diagram ("flow") 400 illustrating integrating wagering content video feeds and web content, according to some embodiments. FIG. 5 is a conceptual diagram that helps illustrate the flow of FIG. 4, according to some embodiments. This description will present FIG. 4 in concert with FIG. 5. In FIG. 4, the flow 400 begins at processing block 402, where a wagering game system ("system") receives a first video feed that depicts a wagering game and receives a second video feed of a player logged in to a wagering game website. The player is associated with a player account (e.g., the player owns or is assigned a player account). For example, in FIG. 5, a wagering game system ("system") 500 captures video of a wagering game. In FIG. 5, the system 500 includes a gaming server 550 connected to a computer 545 via a communications network 522. Also included in the system 500 is a video camera 510 that captures video of a fictitious wagering game-themed show called "Wheel of Riches" (e.g., a roulette game themed show that uses a roulette table 513 as is hosted by a live host 511 filmed at a specific geographic location such as in a television studio 509). The video camera 510 generates a television video feed 561 and provides the television video feed 561 to the gaming server 550. The computer 545 includes a web camera (webcam) 535 that generates a webcam video feed 562 that depicts an image (e.g., image 530) of a wagering game player (e.g., the player "M. Miller" who is logged in to a wagering game website that provides a webpage 503). The computer 545 provides the webcam video feed 562 to the gaming server 550.

The flow 400 continues at processing block 404, where the system selects the player account to participate in the wagering game based on a characteristic of the player account. The characteristic meets a game participation requirement for the wagering game. For instance, the system can detect a player account status, a player account's position on a leader board, a playing history for the player associated with the player account, a performance of a marketing activity by the player and stored in the player account, etc. For example, in FIG. 5, the gaming server 550 can select a player account in response to detecting that a characteristic of the player account meets a game participation requirement. For example, the player M. Miller can be selected because a player account for M. Miller is near a top of a leader board for a slot tournament (e.g., see the leader board 185 in FIG. 1). The gaming server 550 can select other player accounts associated with other players (e.g., players J. Saiz and O. Brown also on the leaderboard 185 indicated in FIG. 1). In some embodiments the system 500 can increase odds of a player being selected based on activities that the player performs. For example, a player can increase their odds of being selected by performing well in other games, by performing marketing activities (e.g., filling out surveys, performing sweepstakes opportunities, etc.), and so forth. The system 500 can also send notifications to players of general times and dates of when players will be selected (e.g., send an email to player accounts notifying them of when the selection will take place). In some embodiments the system 500 can require players to be registered with a specific wagering game website before being selected.

The flow 400 continues at processing block 406, where the system combines the first video feed and the second video feed into a media stream and provides the media stream via webpage for the wagering game website. The gaming server 550 composites the television video feed 561 with the webcam video feed 562 and generates a media stream 563 that is a digitized composite of the television video feed 561 and the webcam video feed 562, combined with audio and/or other computer-generated effects. The gaming server 550 can embed the media stream 563 in the webpage 503 and deliver the webpage to the computer 545 in response to a user request. The gaming server 550 can receive additional webcam video feeds of additional players (e.g., for J. Saiz and O. Brown). The gaming server 550 can composite the additional webcam video feeds into the media stream so that images for the additional players (e.g., images 540 and 590) also appear in the webpage 503.

The flow 400 continues at processing block 408, where the system provides the webpage to a browser application configured to present the wagering game via the media stream. For example, in FIG. 5, the system 500 presents in a web browser 501 a wagering game as a live game show via the media stream 563. During the live game show the system can display live reaction and interaction between the webcam players (e.g., the players M. Miller, J. Saiz, and O. Brown) and an audience (a live audience, additional webcam viewers, etc.). In some embodiments the system 500 can record and play back portions of the media stream 563 (e.g., as advertisements, as replays, etc.). In some embodiments, the wagering game can incorporate wagering activity by the players. For example, the players can place wagers on spaces for the roulette table 513. The system 500 can composite images that represent wagers amounts (e.g., wager indicator images 532, 542, and 592) and space values (e.g., space indicator images 531, 541, and 591). In some embodiments the system 500 can restrict the betting amounts based on player-related characteristics.

Further, the system 500 can present additional controls, such as webcam controls 570 and an inventory access control 571. The inventory access control 571 can access an inventory that belongs to the player account. The inventory may include objects that the player has collected over time to use during the wagering game and/or that the player collects during the wagering game. The objects can persist with the player account so that they remain accessible via the player account beyond a single wagering game session.

Figure 6:
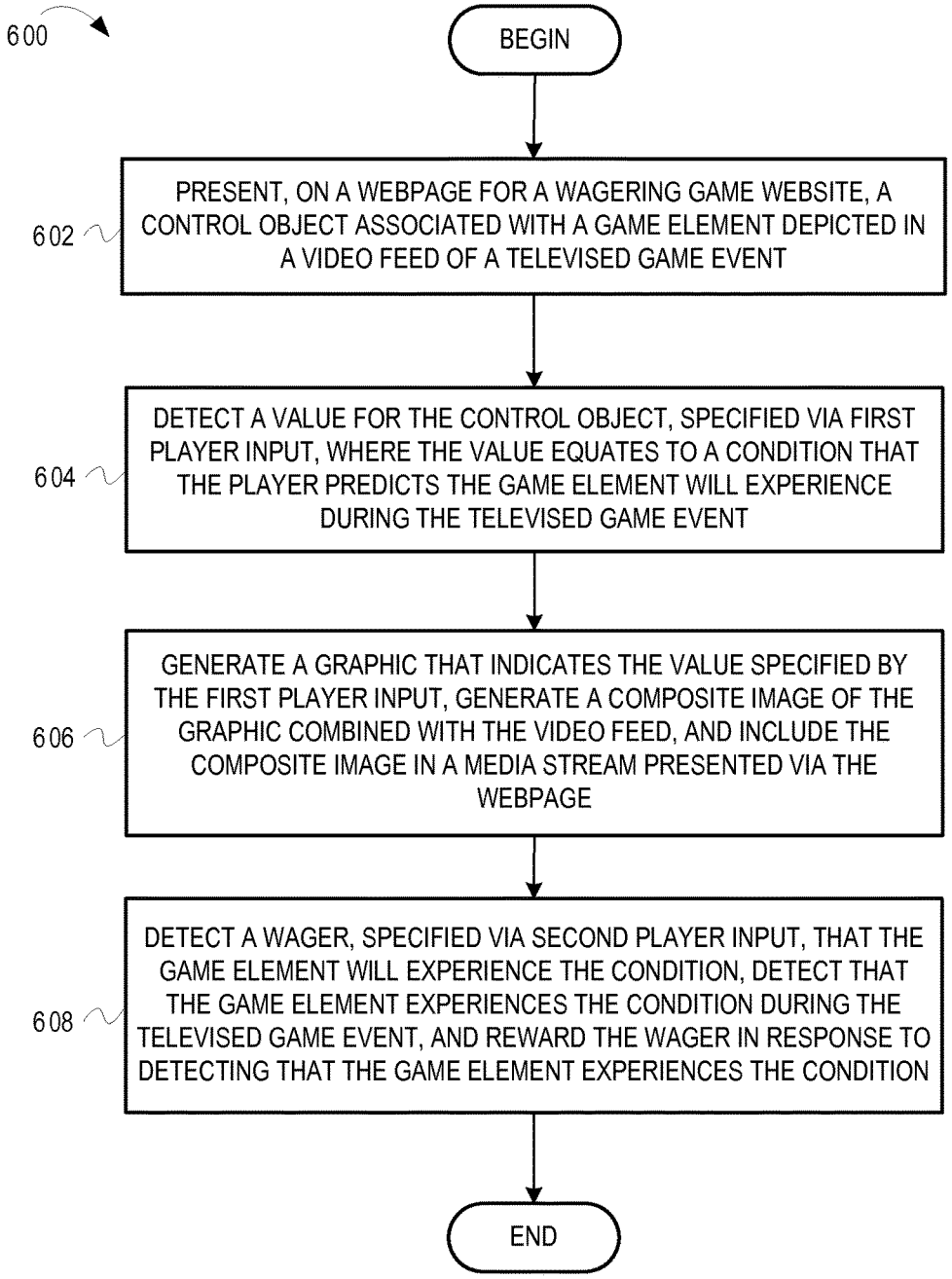
FIG. 6 is a flow diagram 600 illustrating compositing graphical objects in video feeds for gaming, according to some embodiments.
Figure 7:
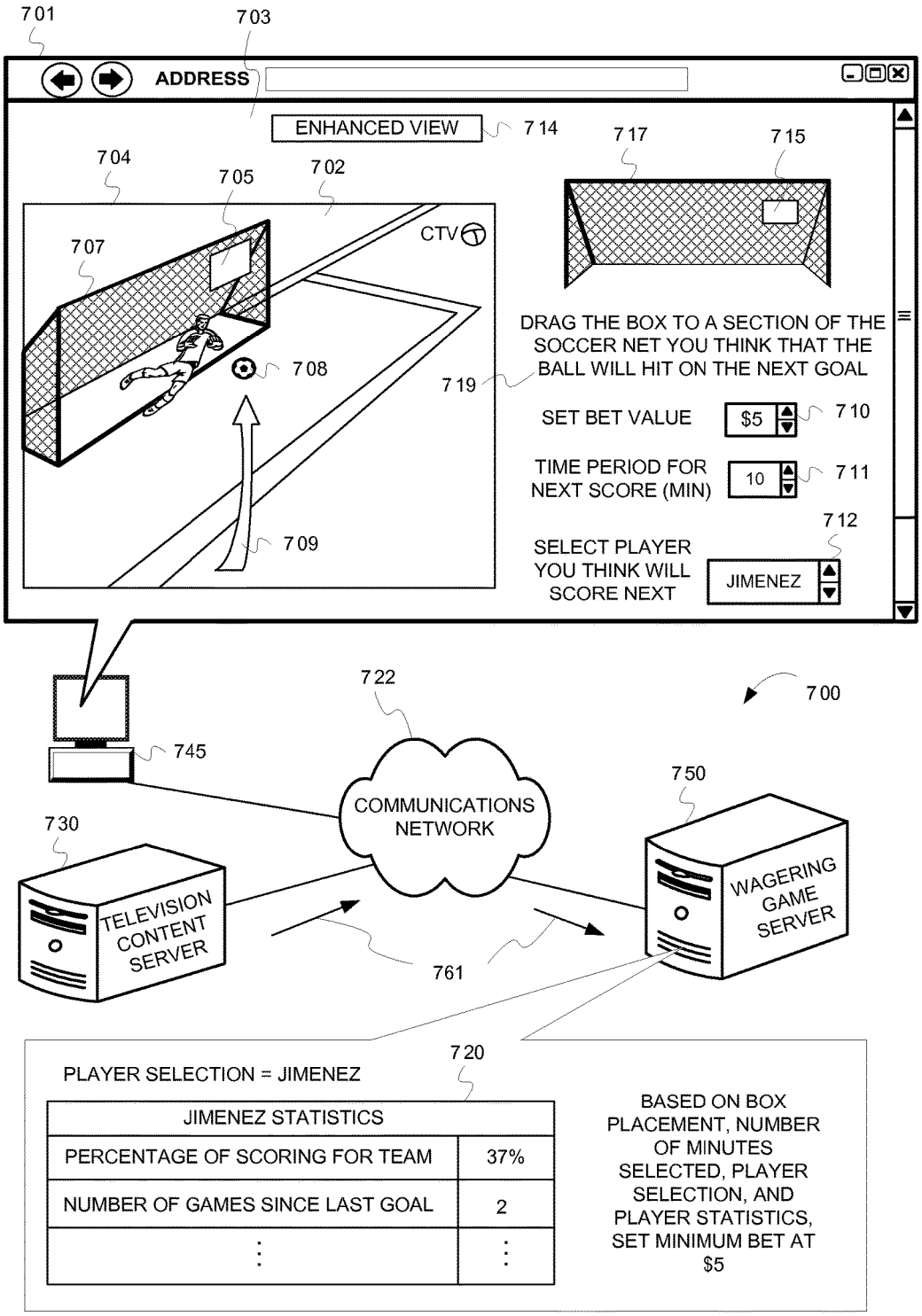
FIG. 7 is an illustration of a wagering game system 700, according to some embodiments.

FIG. 6 is a flow diagram ("flow") 600 illustrating compositing graphical objects in video feeds for gaming, according to some embodiments. FIG. 7 is a conceptual diagram that helps illustrate the flow of FIG. 6, according to some embodiments. This description will present FIG. 6 in concert with FIG. 7. In FIG. 6, the flow 600 begins at processing block 602, where a wagering game system ("system") presents, on a webpage for a wagering game website, a control object associated with a game element depicted in a video feed of a televised game event. At processing block 604, the system detects a value for the control object, specified via first player input, where the value equates to a condition that the player predicts the game element will experience during the televised game event. For example, in some embodiments, the system can present a control object that a player uses to specify a position on a playing area for the televised game event. The system detects a customization of the position in response to player input. The customizing sets the control object in a first position on the depiction of the playing area. The first position specifies a player-prediction that a scoring object will react with a score-keeping object at the first position during the televised game event. For example, in FIG. 7, a wagering game system ("system") 700 includes a wagering game server 750 connected to a television content server 730 and a computer 745 via a communications network 722. The wagering game server 750 can receive a video feed of a television broadcast of a game event ("televised game event") 761 to present on a webpage 703. The computer 745 can present the webpage 703 in a browser 701. The wagering game server 750 can also present on the webpage 703 a user-customizable graphical object (e.g., prediction control 715) that is associated with a depiction of some portion of a playing area, such as a graphical image of a net ("virtual soccer net") 717 that represents a video recorded image of a net ("televised soccer net") 707. The prediction control 715 is configured so that a player can position the prediction control 715, via player input, at a position in front of the virtual net 717. The wagering game server 750 can generate a composite image 702 of the televised game event 761 combined with a graphical overlay object (e.g., prediction indicator 705). A position for the prediction indictor 705 in front of the televised soccer net 707 coincides with the position of the prediction control 715 in front of the virtual net 717. The position of the prediction control 715 in front of the virtual net 717 indicates a prediction that the player makes that a ball 708 will enter the area occupied by the prediction indicator 705 (i.e., "hit" the prediction indicator 705) during the soccer match during a scoring event (e.g., a goal) for the soccer game. The system 700 generates the prediction indicator 705 and composites the prediction indicator 705 with the video image of the televised soccer net 707 into a composite image 704 that includes the video image 702 of the televised game event 761 composited with the prediction indicator 705.

The system 700 can also present controls that control, or impose, other conditions. For example, the system 700 can present on the webpage 703 a control object 711 that specifies a time period in which the ball 708 will hit the prediction indicator 705 (e.g., a time period that specifies a certain number of minutes after a wager is placed, a time period that specifies a time range for the official soccer match time such as between the $60^{th}$ and $80^{th}$ minute of the match, etc.). In another example, the system 700 can also present a control object 712 that specifies a game event player (e.g., the soccer player "Jimenez") that the wagering game player thinks will score the goal. The system 700 can modify odds, minimum bet values, rewards, etc. based on the number of the conditions and/or the values of the conditions. For example, if the player specifies a very short range of time using the control object 711, selects a player who does not statistically score often via the control object 712, places the prediction control 715 in a position that is rare for a goal shot, etc., the system can modify the potential reward to be higher as the odds of winning may reduce based on the conditions. In some embodiments, the system 700 can calculate statistics for the soccer player, the match, a team, or other factors associated with the televised game event 761 and, based on the conditions specified by the wagering game player, set odds, maximum or minimum bet values (e.g., modify the value or set limits on the value of a bet entered into a betting control 710 based on the statistics 720 for the player "Jimenez").

The flow 600 continues at processing block 606, where the system generates a graphic that indicates the value specified by the first player input, generates a composite image of the graphic combined with the video feed, and includes the composite image in a media stream presented via the webpage. Further, at processing block 608, the system detects a wager, specified via second player input, that the game element will experience the condition, detects that the game element experiences the condition during the televised game event, and rewards the wager in response to detecting that the game element experiences the condition. In FIG. 7, as described previously, the system 700 generated the prediction indicator 705 and composited the prediction indicator 705 with the video image of the televised soccer net 707 into the composite image 704. The system 700 detects, during the televised game event 761, that the ball 708 appears in a second position on a video image of the playing area. The second position can be within a given distance to the first position of the value specified by the control object on the depiction of the playing area. For example, in FIG. 7, the ball 708 can be an example of a specified televised object (e.g., specified in the comments 719 on the webpage 703). In the televised game event 761, the ball 708 may be directed (e.g., by the soccer player "Jimenez") toward the televised soccer net 707 in an attempt to score the goal. The position of the ball 708 may come within a certain distance of the position of the prediction indicator 705 during the course of the goal. For instance, the ball 708 may touch, or come within a certain number of inches, feet, etc. to, the position of the prediction indicator 705. The system 700 can also presents an animated action indicator 709 that shows a path of the ball 708, or other composited images.

The system 700 can present, via the compositing, an interaction between the prediction indicator 705 and the ball 708 on the video image of the playing area. The system can show the ball 708 touching or passing through the prediction indicator 705. In some embodiments, the system 700 can cause the prediction indicator 705 to become highlighted, to appear to shatter, or experience some other effect, to indicate that the ball 708 and the prediction indicator 705 interacted. In some embodiments, the system 700 may not require or allow betting, but may provide a reward (e.g., a bonus award, a non-monetary award, etc.) based on where the player guesses that the ball 708 will hit the televised soccer net 707. In some embodiments, the system 700 can also award prizes based on a player's history of predicting events that occur within the televised game event 761, such as a history of predictions of where the ball 708 will hit the televised soccer net 707. The system 700 can track, over time, scores associated with predictions of object positions, interactions, etc., within the depictions of a playing area of the televised game event 761 and award prizes based on overall scores.

In some embodiments, the system 700 can composite additional objects with the televised feed (e.g., animated objects such as obstacles, characters, etc.) that appear to interact with live video objects. For instance, the system 700, either automatically or via player input, can present an obstacle in the path of a soccer player and if the soccer player runs through the obstacle then the system 700 can cause the obstacle to react in a specific way. In some embodiments, the system 700 can also cause animated characters (e.g., a an animated defender character) to appear to interact with televised characters (e.g., the animated defender character appears to approach a televised character, but the televised character cuts left while the animated defender character continues right, causing the animated defender character to fall down). The system 700 can run the televised game event slightly delayed to know an outcome of the televised game event and provide data that the system 700 can use to generate an animated overlay object that appears to react to the televised game event 761. The system 700 can also provide betting on potential interactions between overlay objects and televised game events.

In some embodiments, the system 700 can provide settings for the player to specify which of the composited objects the player wants to appear on the composite image 704. For instance, the system 700 can include a control 714 that toggles a view of the prediction indicator 705 and the animated action indicator 709. The system 700 can also composite objects with replays of the televised game event 761. The system 700 can use statistics associated with televised game event 761 to generate images, composite images, cause composited objects to appear interact, take wagers, etc. For example, the system 700 can take bets on which way a televised game player is going to perform an activity (e.g., run to the left, fold a hand, hit a ball, score a point, etc.) and can scale the odds based on the statistics of that player's normal statistics for performing that activity (e.g., the system 700 references player statistics that indicate that a specific player runs right 70% of the time on first down, so can scale the payout-out of the bets so that the betting option for the player to run left is a higher payout).

Additional Example Embodiments

According to some embodiments, a wagering game system ("system") can provide various example devices, operations, etc., to integrate video feeds and wagering-game web content. The following non-exhaustive list enumerates some possible embodiments.

In some embodiments, the system can composite images in a way that personalizes or customizes a video feed. For example, in some embodiments, the system can detect data stored in a player account and generate graphical representations of the data (e.g., in FIG. 1 the system 100 generates graphical images of a credit balance and a denomination that were selected during an online wagering game session by a player and composites the images of the credit balance and the denomination). In some embodiments, the system can generate graphics that look different based on player or player account information (e.g., player status, player statistics, player wager history, etc.). For example, the system can generate different looking or functioning wild reel elements and present the different looking wild reel elements to different player accounts logged in to a wagering game website. In some embodiments, the system can composite images stored in the player account, such as images of an avatar. In some embodiments, the system can detect preferences (e.g., preferred theme, color, font, background, etc.) specified by the player account and composite images that represent the preferences with video imagery. In some embodiments, the system can present the composited images on one or more webpages that multiple players can access and view simultaneously. Some of the composited images can be customized to some of the player accounts as described above (e.g., different wild reel elements, different themes, different avatars, etc.) so that each player sees a customized view of a video feed. The system can present player images (e.g., webcam images of the player, avatar, etc.) on the objects of the live video broadcast (e.g., on a televised athletic player, on a televised roulette table, on places of a card table, etc.). For example, in FIG. 7, the gaming server 750 composites images 707 of M. Miller's avatar. The system can also personalize appearance of some objects by overlaying themes selected by the player/stored in player settings (e.g., system customizes the backs of cards, a video background, etc. with a player-specified theme). In some embodiments, the system can also present marketing images (e.g., ads) on objects. The marketing images can be targeted to players based on data stored in player accounts.

In some embodiments, the system can detect values on a roulette wheel. The roulette wheel is recorded in a video feed. The system can use the values on the roulette wheel to trigger, or detect when the values on the roulette wheel trigger, a bonus game on a wagering game website (e.g., trigger a progressive bonus).

In some embodiments, the system can present video content (e.g., a video feed) of a first wagering game with non-video content (e.g., a computer generated Adobe® Flash® animation) of a second wagering game on a webpage. A combined event for both wagering games can trigger a bonus game, or other gaming event. The system can composite images of the bonus content for the bonus game, or other event, into either the video content of the first wagering game and/or in the non-video content of the second wagering game. For instance, a video feed can include a depiction of a first roulette wagering game. The video feed can include a video recorded image of a first roulette wheel. The first roulette wagering game can provide an outcome having a first value. For instance a first ball falls into a first space on the first roulette wheel, (e.g., the space has a value of "3"). The system can composite a graphical representation of a second roulette wheel on the webpage separate from the video feed. The second roulette wheel is for a second roulette wagering game. The player on the website can bet on either roulette board. The system can detect a first wager placed on the first value of the first roulette wheel via the wagering game player account. The system can also detect a second wager placed on a second value of the second roulette wheel (e.g., the value "19"). The second wager is also associated with the wagering game player account. The system can detect that a second wagering game outcome for the second roulette wagering game results in the second value. The first value and the second value can be related to each other via game rules or other conditions associated with the secondary wagering game. For example, the secondary wagering game may randomly select two values (e.g., randomly select the values "4" and "20"). The secondary game may have game rules that relate the randomly selected values to the values that occur on the roulette wheels given certain conditions. For example the secondary wagering game can reward any player who placed two bets on two values on the two separate wheels that most closely resemble the two randomly selected values for the secondary wagering game. For example, the player that placed the bets on the values of "3" and "19" may be closest to the randomly selected values of "4" and "20. The secondary game may impose additional conditions such as that the player must win at least one of the two bets that were placed on the two roulette wheels. In other examples the rules and/or conditions of the secondary game may provide greater rewards if the two balls land on the same spot, or if they land within a certain number of spaces or values of each other. In some embodiments, pay tables for both games can also be linked together to determine values for the reward in the secondary game. In some embodiments, the two roulette wheels can spin concurrently. The ball movement can begin at around the same time so that the ball movement on the two wheels can move nearly parallel to each other's movements while the wheels are spinning. Because the second roulette wheel is computer generated or "virtual," the system can manipulate the movement of the second roulette wheel to move slightly slower than the first roulette wheel which is video recorded. For the second wagering game, the system can automatically adjust the placement of a virtual ball on a virtual wheel based on the value of the space in which the live ball comes to rest on the live reel (e.g., cause the virtual ball to land on the same space to trigger to a bonus game).

In some embodiments, the system presents a first wagering game via video and a second wagering game on a website. The system can increase a payout percentage for either the first wagering game or the second wagering game by periodically triggering a bonus wagering game. In some embodiments, when the system triggers a bonus game, to prevent the player from missing some of the activity of either the first wagering game or the second wagering game, the system can present the bonus game in a secondary display or object (e.g., picture-in-picture).

In some embodiments, the system can track a number of players logged in to a wagering game website that watch a video feed of a video recorded wagering game and use the number of viewers to increase a percentage-payout of either the video recorded wagering game or one or other wagering games presented on the website. The system can utilize dynamic pay tables that increase based on the number of players watching online. The dynamic pay tables, however, can have a limit (e.g., stop rising after a certain number of players are watching). In another embodiment, to increase payout percentages on a recorded video game from a wagering game machine, the system can increase odds of a bonus hitting on a wagering game machine. In some embodiments, the system can impose conditions on the wagering game machine before the system will increase the odds. For example, the system can require that the wagering game machine be associated with (e.g. linked to) an online progressive game that is available only for players that are registered at the wagering game website.

In some embodiments, the system can cause a gaming toolbar within a browser to respond to events within a televised game event. For example, if a specific event occurs in the televised game event, then the system can cause slot reels to spin on the gaming toolbar.

In some embodiments, the system can broadcast a live gambling show via a wagering game website. The system can present, during the live gambling show, a bonus game that shifts a focus of television camera from a main game environment to a separate room for the bonus game. The separate room can have a theme of a particular game, such as a guessing game with actors holding boxes that represent either money values from a bonus game budget or a "pooper" object that causes the bonus game to end. The system can cause the boxes to be interactive. For example, the system can overlay selectable graphics that a player can select via the wagering game website. The system can select a player logged on to the wagering game website to interact in the bonus round. If the player selects, via the website, a money value, then the money value can transfer to an account balance for the player's gaming account. The system can also communicate the results back to those individuals that are participating in the live gambling show. For example, if the player picks a box, the actor holding the box can be notified of the player's selection and the actor can open the box. The system can generate and composite congratulatory graphics, animations, etc. via the website. If the player picks the pooper, then an actor can respond via the live gambling show (e.g., a clown character comes on stage and sprays the camera lens with water ending the bonus round). In some embodiments, the separate room for the bonus round may only be accessible to players with webcams. The system can select a player from a web-cam room to participate in the live-game show or the bonus round portion of the live game show.

In some embodiments, the system can encourage players on a wagering game website to participate in a live game shows by offering higher prizes in games and/or rooms from which players are selected for the live game show, by offering player loyalty points, by providing chances to play new or modified slot games, or by providing other potential rewards.

In some embodiments, the system can present on a wagering game website a video recording of a non-gaming show such as a recast of a drama, a sit-com, etc. The system can composite the video recording of the non-gaming show with game elements of a non-wagering game (e.g., a trivia game). The system can cause the composited game elements to pop-up during the non-gaming show (e.g., trivia questions pop-up during the show with questions related to the show). Players can watch the show and play the non-wagering game only if they are logged in to the wagering game website or are, or have recently been, gambling via the wagering game website. Players can earn points for the game elements in the non-wagering game (e.g., earn points for correctly answering the trivia questions).

In some embodiments, the system can generate and composite hidden graphics on a media stream of a live event. A player can click on the representation of the media stream to select the hidden graphics (e.g., to find a hidden item on the screen).

In some embodiments, the system can provide persisted objects that a player can earn via a website, via live games, etc. The system can detect that a player selects one of the persisted objects and the system can composite images of the persisted object with a live video stream of a recorded wagering game. The use of the persisted object can cause an effect in a wagering game. For example, a player can plays games on a wagering game website and gather cards or other game elements that persist with the player account that can be used during a subsequent live wagering game show. The system can also provide ways for players to acquire the persisted objects from in-casino games, from marketers, etc. In one example, the system can present a first wagering game (e.g., a blackjack game). During the blackjack game a player may be dealt an ace of spades. The player can surrender the bet in the blackjack game in favor of keeping the card so that the player can use it later during a second, subsequent wagering game. The system can present the second wagering game, such as a live feed of a poker game, with an award that is awarded every hour for the person with a winning hand with the highest spade. The player can, via the system, swap out an ace of a non-spade suit during the poker game, and use the ace of spades card earned from the first wagering game. The system can provide an inventory, as described previously, from which the player can select the ace of spades card.

In some embodiments, the system can modify an appearance of a browser application in response to detecting an occurrence of an event or condition (e.g., a score occurs, a poker hand appears, a reel-stop combination occurs, winning result occurs for a wager, etc.) in a video feed. For example, in FIG. 7, the system 700 can modify an appearance of the televised game event 761 on a website view (e.g., minimize and maximize the composited image 704, a tab, a window, etc., in which the televised game event 761 is depicted, zoom in an out of images on the composited image 704, generate a picture in picture in the composited image 704, etc.) based on triggering events (e.g., events in the televised game event 761 such as a scoring event) or triggers in the wagering game website (e.g., trigger in a secondary wagering game). For example, when an athlete scores a goal in the televised game event 761, the system can automatically maximize a browser window. In some embodiments, the system can minimize the browser window automatically if an event occurs on the wagering game website (e.g., a secondary game is triggered) separate from the televised game event 761.

In some embodiments, the system can blanket usage of overlays via a cell phone network.

Additional Example Operating Environments

This section describes example operating environments, systems and networks, and presents structural aspects of some embodiments.

Wagering Game Computer System

Figure 8:
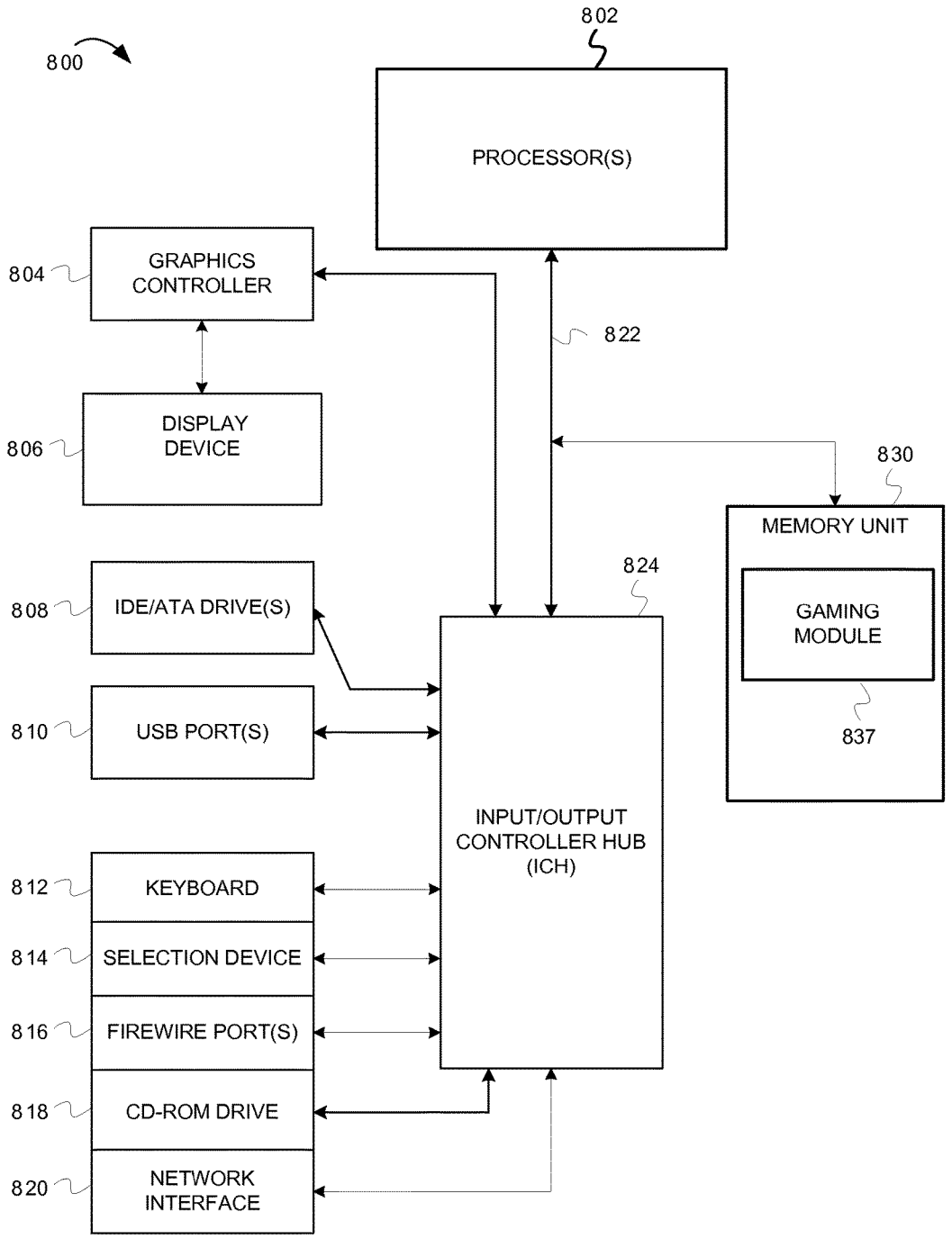
FIG. 8 is an illustration of a wagering game computer system 800, according to some embodiments.

FIG. 8 is a conceptual diagram that illustrates an example of a wagering game computer system 800, according to some embodiments. In FIG. 8, the wagering game computer system ("computer system") 800 may include a processor unit 802, a memory unit 830, a processor bus 822, and an Input/Output controller hub (ICH) 824. The processor unit 802, memory unit 830, and ICH 824 may be coupled to the processor bus 822. The processor unit 802 may comprise any suitable processor architecture. The computer system 800 may comprise one, two, three, or more processors, any of which may execute a set of instructions in accordance with some embodiments.

The memory unit 830 may also include an I/O scheduling policy unit and I/O schedulers. The memory unit 830 can store data and/or instructions, and may comprise any suitable memory, such as a dynamic random access memory (DRAM), for example. The computer system 800 may also include one or more suitable integrated drive electronics (IDE) drive(s) 808 and/or other suitable storage devices. A graphics controller 804 controls the display of information on a display device 806, according to some embodiments.

The input/output controller hub (ICH) 824 provides an interface to I/O devices or peripheral components for the computer system 800. The ICH 824 may comprise any suitable interface controller to provide for any suitable communication link to the processor unit 802, memory unit 830 and/or to any suitable device or component in communication with the ICH 824. The ICH 824 can provide suitable arbitration and buffering for each interface.

For one embodiment, the ICH 824 provides an interface to the one or more IDE drives 808, such as a hard disk drive (HDD) or compact disc read only memory (CD ROM) drive, or to suitable universal serial bus (USB) devices through one or more USB ports 810. For one embodiment, the ICH 824 also provides an interface to a keyboard 812, selection device 814 (e.g., a mouse, trackball, touchpad, etc.), CD-ROM drive 818, and one or more suitable devices through one or more firewire ports 816. For one embodiment, the ICH 824 also provides a network interface 820 though which the computer system 800 can communicate with other computers and/or devices.

The computer system 800 may also include a machine-readable storage medium that stores a set of instructions (e.g., software) embodying any one, or all, of the methodologies for integrate video feeds and wagering-game web content. Furthermore, software can reside, completely or at least partially, within the memory unit 830 and/or within the processor unit 802. The computer system 800 can also include a gaming module 837. The gaming module 837 can process communications, commands, or other information, to integrate video feeds and wagering-game web content. Any component of the computer system 800 can be implemented as hardware, firmware, and/or machine-readable storage media including instructions for performing the operations described herein.

Personal Wagering Game System

Figure 9:
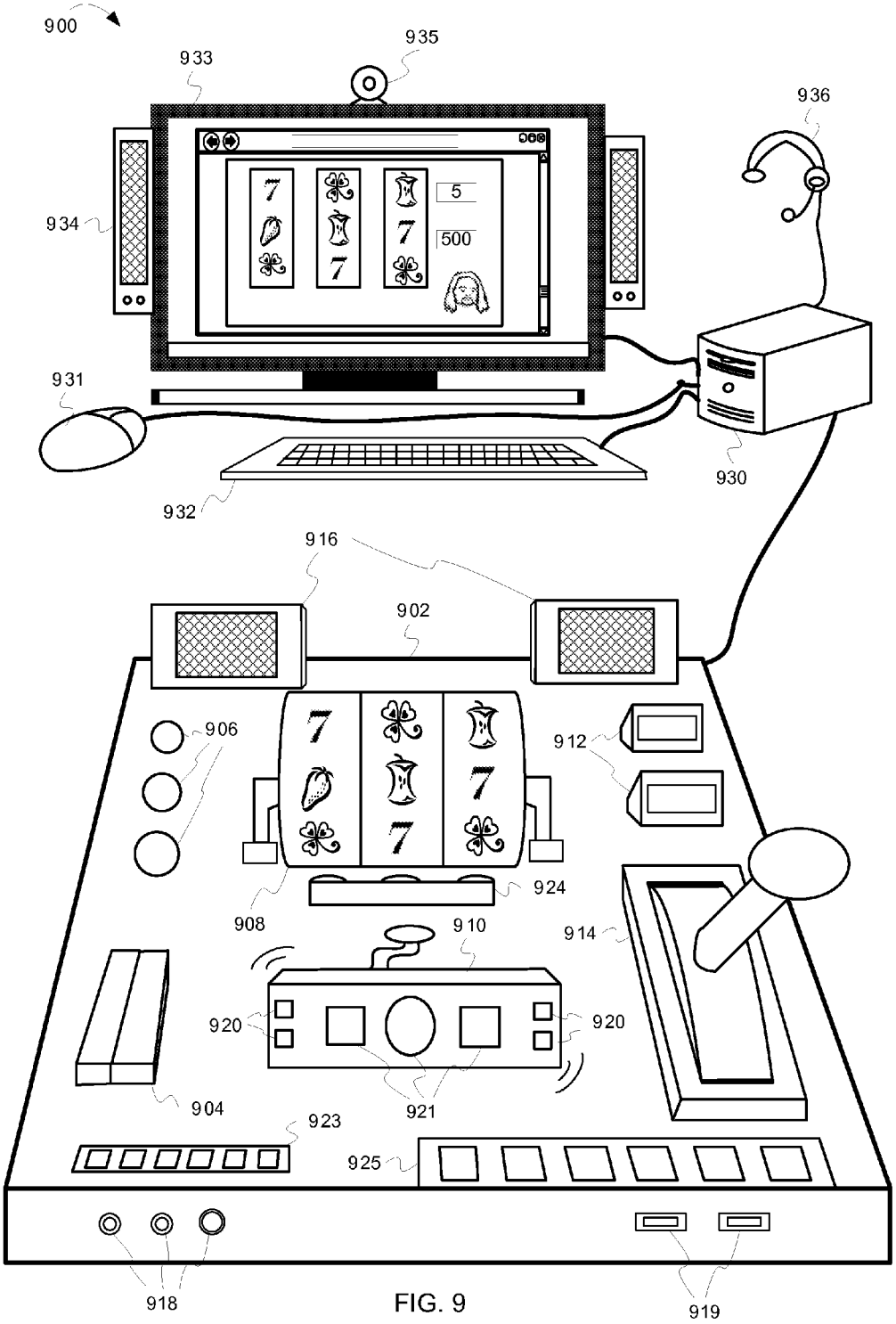
FIG. 9 is an illustration of a personal wagering game system 900, according to some embodiments.

FIG. 9 is a conceptual diagram that illustrates an example of a personal wagering game system 900, according to some embodiments. In FIG. 9, the personal wagering game system ("system") 900 includes an exemplary computer system 930 connected to several devices, including user input devices (e.g., a keyboard 932, a mouse 931), a web-cam 935, a monitor 933, speakers 934, and a headset 936 that includes a microphone and a listening device. In some embodiments, the webcam 935 can detect fine details of a person's facial features, from an eye-level perspective. The web-cam 935 can use the fine detail to determine a person's identity, their demeanor, their facial expressions, their mood, their activities, their eye focus, etc. The headset 936 can include biometric sensors configured to detect voice patterns, spoken languages, spoken commands, etc. The biometric sensors in the web-cam 935 can detect colors (e.g., skin colors, eye colors, hair colors, clothing colors, etc.) and textures (e.g., clothing material, scars, etc.). The biometric sensors in the web-cam 935 can also measure distances between facial features (e.g., distance between eyes, distance from eyes to nose, distance from nose to lips, length of lips, etc.). The system 900 can generate a facial and body map using the detected colors, textures, and facial measurements. The system 900 can use the facial and body map to generate similar facial features and body appearances for a player account avatar. Also connected to the computer system 930 is a gaming control device ("gaming pad") 902 including wagering game accoutrements associated with wagering games. The wagering game accoutrements include one or more of prop reels 908, prop game meters 912, indicators 906, a game control device 910, a physical lever 914, a magnetic card reader 904, a video projection device 924, input/output ports 918, USB ports 919, and speakers 916. The gaming pad 902 can present feedback of online activities. For instance, the gaming pad 902 can use vibrations and signals on the gaming control device (e.g., the game control device 910 or the physical lever 914 can vibrate to indicate a back pat from another player or a game celebration, the indicators 906 can blink, etc.). The physical lever 914 can produce feelings in the lever to emulate a pulling feel or a vibration. The video projection device 924 can project video onto the prop reels 908 so that the prop reels 908 can present many different types of wagering games. The prop reels 908 can spin when the physical lever 914 is pulled. The video projection device 924 can project reel icons onto the prop reels 908 as they spin. The video projection device 924 can also project reel icons onto the prop reels 908 when the prop reels 908 are stationary, but the imagery from the video project device 924 makes the prop reels 908 appear to spin. The magnetic card reader 904 can be used to swipe a credit card, a player card, or other cards, so that the system can quickly get information. The system 900 can offer lower rates for using the magnetic card reader 904 (e.g., to get a lower rate per transaction). The game control device 910 can include an emotion indicator keypad with keys 920 that a player can use to indicate emotions. The game control device 910 can also include biometric devices 921 such as a heart-rate monitor, an eye pupil dilation detector, a fingerprint scanner, a retinal scanner, voice detectors, speech recognition microphones, motion sensors, sound detectors, etc. The biometric devices 921 can be located in other places, such as in the headset 936, within a chair (not shown), within personal control devices (e.g. joysticks, remote controls, game pads, roller-balls, touch-pads, touch-screens, etc.), within the web-cam 935, or any other external device. The external devices can be connected to the computer 930 or to the game control device 910 via the input/output ports 918. As a security feature, some biometric devices can be associated with some of the gaming pad devices (e.g., the magnetic card reader 904), such as a fingerprint scanner, a retinal scanner, a signature pad to recognize a player's signature, etc. The game control device 910 can also use the keys 920 to share items and control avatars, icons, game activity, movement, etc. within a network wagering venue. The game pad can also have an electronic (e.g., digital) button panel 925, an electronic control panel 923, or any other type of changeable panel that can change appearance and/or configuration based on the game being played, the action being performed, and/or other activity presented within an online gaming venue. The game control device 910 can also move in different directions to control activity within the online gaming venue (e.g., movement of a player's avatar moves in response to the movements of the game control device 910). Avatars can be pre-programmed to act and look in certain ways, which the player can control using the system 900. The gaming pad 902 can permit the player to move the avatar fluidly and more easily than is possible using a standard keyboard. The system 900 can cause an avatar to respond to input that a player receives via the gaming pad 902. For example, a player may hear a sound that comes primarily from one direction (e.g., via stereophonic signals in the headset 936) within the network wagering venue. The system 900 can detect the movement of the player (e.g., the system 900 detects that a player moves his head to look in the direction of the sound, the player uses the game control device 910 to move the avatar's perspective to the direction of the sound, etc.). The system 900 can consequently move the avatar's head and/or the avatar's perspective in response to the player's movement. The player can indicate an expression of an emotion indicated by the player using the keys 920. The system 900 can make the avatar's appearance change to reflect the indicated emotion. The system 900 can respond to other movements or actions by the player and fluidly move the avatar to respond. The system 900 can also interpret data provided by the biometric devices and determine expressions and/or indications of emotions for a player using the system 900.

Wagering Game Machine Architecture

Figure 10:
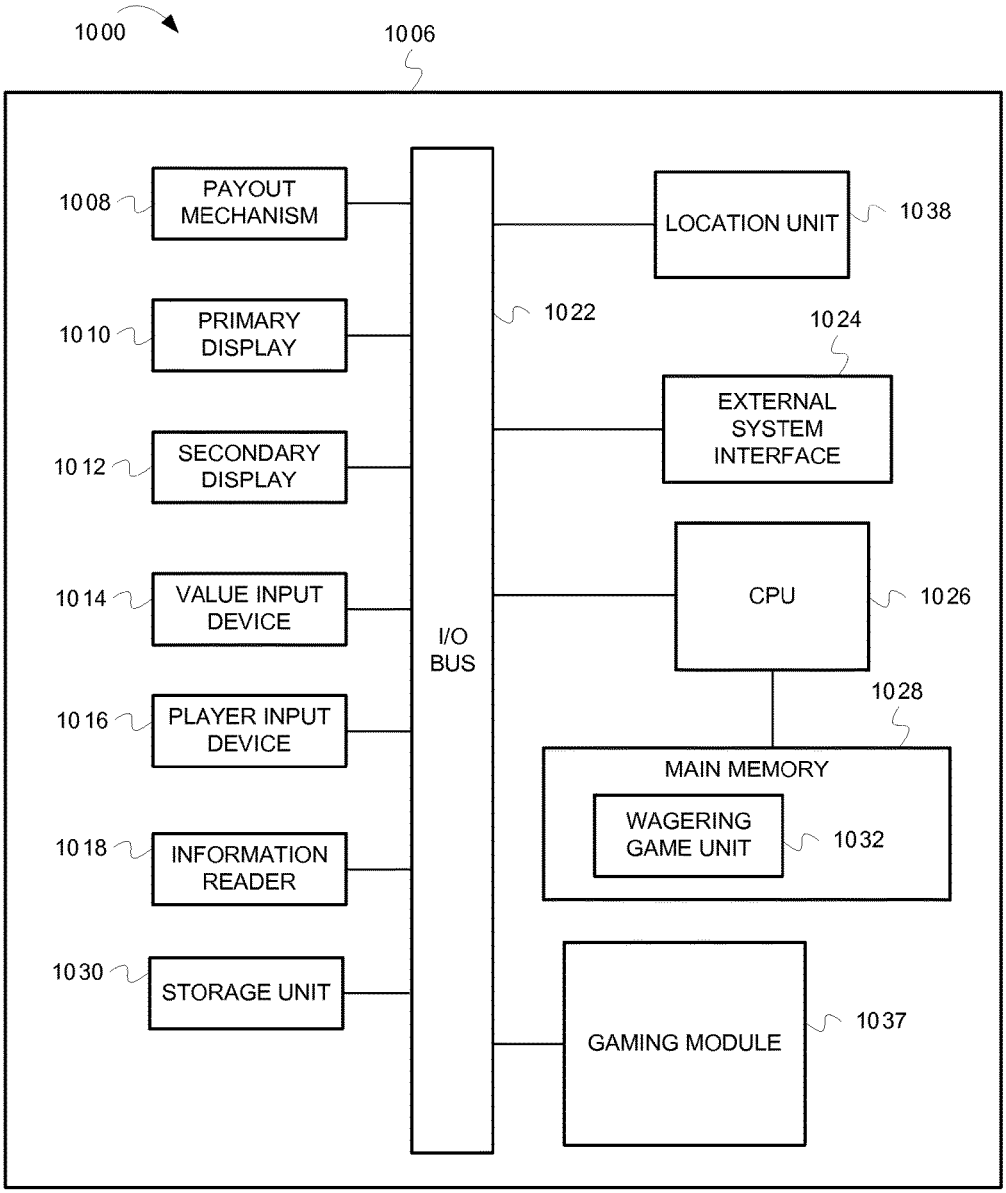
FIG. 10 is an illustration of a wagering game machine architecture 1000, according to some embodiments.

FIG. 10 is a conceptual diagram that illustrates an example of a wagering game machine architecture 1000, according to some embodiments. In FIG. 10, the wagering game machine architecture 1000 includes a wagering game machine 1006, which includes a central processing unit (CPU) 1026 connected to main memory 1028. The CPU 1026 can include any suitable processor, such as an Intel® Pentium processor, Intel® Core 2 Duo processor, AMD Opteron™ processor, or UltraSPARC processor. The main memory 1028 includes a wagering game unit 1032. In some embodiments, the wagering game unit 1032 can present wagering games, such as video poker, video black jack, video slots, video lottery, reel slots, etc., in whole or part.

The CPU 1026 is also connected to an input/output ("I/O") bus 1022, which can include any suitable bus technologies, such as an AGTL+ frontside bus and a PCI backside bus. The I/O bus 1022 is connected to a payout mechanism 1008, primary display 1010, secondary display 1012, value input device 1014, player input device 1016, information reader 1018, and storage unit 1030. The player input device 1016 can include the value input device 1014 to the extent the player input device 1016 is used to place wagers. The I/O bus 1022 is also connected to an external system interface 1024, which is connected to external systems (e.g., wagering game networks). The external system interface 1024 can include logic for exchanging information over wired and wireless networks (e.g., 802.11g transceiver, Bluetooth transceiver, Ethernet transceiver, etc.)

The I/O bus 1022 is also connected to a location unit 1038. The location unit 1038 can create player information that indicates the wagering game machine's location/movements in a casino. In some embodiments, the location unit 1038 includes a global positioning system (GPS) receiver that can determine the wagering game machine's location using GPS satellites. In other embodiments, the location unit 1038 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 10, in some embodiments, the location unit 1038 is not connected to the I/O bus 1022.

In some embodiments, the wagering game machine 1006 can include additional peripheral devices and/or more than one of each component shown in FIG. 10. For example, in some embodiments, the wagering game machine 1006 can include multiple external system interfaces 1024 and/or multiple CPUs 1026. In some embodiments, any of the components can be integrated or subdivided.

In some embodiments, the wagering game machine 1006 includes a gaming module 1037. The gaming module 1037 can process communications, commands, or other information, where the processing can integrate video feeds and wagering-game web content.

Furthermore, any component of the wagering game machine 1006 can include hardware, firmware, and/or machine-readable storage media including instructions for performing the operations described herein.

Wagering Game Machine

Figure 11:
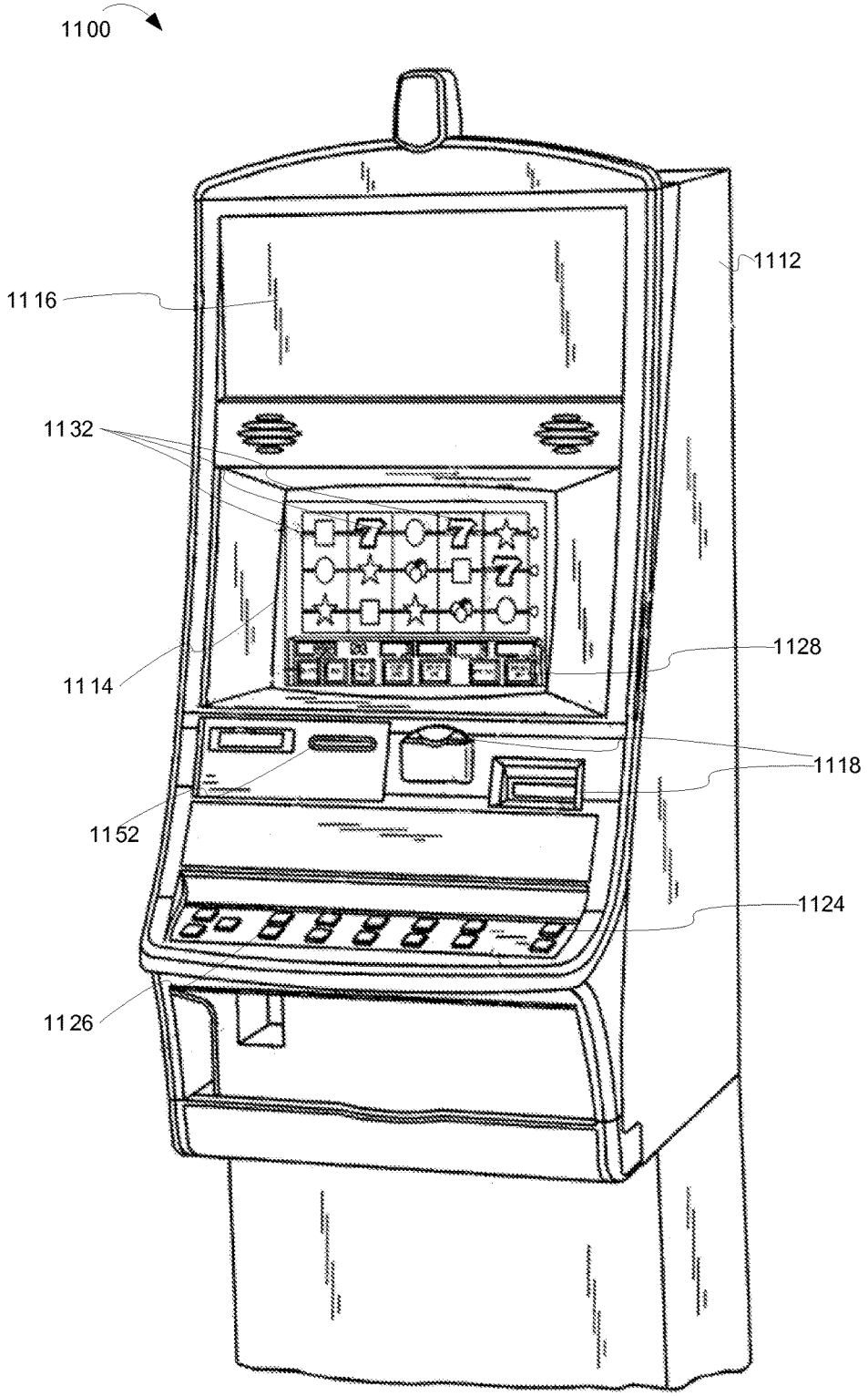
FIG. 11 is an illustration of a wagering game machine 1100, according to some embodiments.

FIG. 11 is a conceptual diagram that illustrates an example of a wagering game machine 1100, according to some embodiments. Referring to FIG. 11, the wagering game machine 1100 can be used in gaming establishments, such as casinos. According to some embodiments, the wagering game machine 1100 can be any type of wagering game machine and can have varying structures and methods of operation. For example, the wagering game machine 1100 can be an electromechanical wagering game machine configured to play mechanical slots, or it can be an electronic wagering game machine configured to play video casino games, such as blackjack, slots, keno, poker, blackjack, roulette, etc.

The wagering game machine 1100 comprises a housing 1112 and includes input devices, including value input devices 1118 and a player input device 1124. For output, the wagering game machine 1100 includes a primary display 1114 for displaying information about a basic wagering game. The primary display 1114 can also display information about a bonus wagering game and a progressive wagering game. The wagering game machine 1100 also includes a secondary display 1116 for displaying wagering game events, wagering game outcomes, and/or signage information. While some components of the wagering game machine 1100 are described herein, numerous other elements can exist and can be used in any number or combination to create varying forms of the wagering game machine 1100.

The value input devices 1118 can take any suitable form and can be located on the front of the housing 1112. The value input devices 1118 can receive currency and/or credits inserted by a player. The value input devices 1118 can include coin acceptors for receiving coin currency and bill acceptors for receiving paper currency. Furthermore, the value input devices 1118 can include ticket readers or barcode scanners for reading information stored on vouchers, cards, or other tangible portable storage devices. The vouchers or cards can authorize access to central accounts, which can transfer money to the wagering game machine 1100.

The player input device 1124 comprises a plurality of push buttons on a button panel 1126 for operating the wagering game machine 1100. In addition, or alternatively, the player input device 1124 can comprise a touch screen 1128 mounted over the primary display 1114 and/or secondary display 1116.

The various components of the wagering game machine 1100 can be connected directly to, or contained within, the housing 1112. Alternatively, some of the wagering game machine's components can be located outside of the housing 1112, while being communicatively coupled with the wagering game machine 1100 using any suitable wired or wireless communication technology.

The operation of the basic wagering game can be displayed to the player on the primary display 1114. The primary display 1114 can also display a bonus game associated with the basic wagering game. The primary display 1114 can include a cathode ray tube (CRT), a high resolution liquid crystal display (LCD), a plasma display, light emitting diodes (LEDs), or any other type of display suitable for use in the wagering game machine 1100. Alternatively, the primary display 1114 can include a number of mechanical reels to display the outcome. In FIG. 11, the wagering game machine 1100 is an "upright" version in which the primary display 1114 is oriented vertically relative to the player. Alternatively, the wagering game machine can be a "slant-top" version in which the primary display 1114 is slanted at about a thirty-degree angle toward the player of the wagering game machine 1100. In yet another embodiment, the wagering game machine 1100 can exhibit any suitable form factor, such as a free standing model, bar top model, mobile handheld model, or workstation console model.

A player begins playing a basic wagering game by making a wager via the value input device 1118. The player can initiate play by using the player input device's buttons or touch screen 1128. The basic game can include arranging a plurality of symbols 1132 along a pay line, which indicates one or more outcomes of the basic game. Such outcomes can be randomly selected in response to player input. At least one of the outcomes, which can include any variation or combination of symbols, can trigger a bonus game.

In some embodiments, the wagering game machine 1100 can also include an information reader 1152, which can include a card reader, ticket reader, bar code scanner, RFID transceiver, or computer readable storage medium interface. In some embodiments, the information reader 1152 can be used to award complimentary services, restore game assets, track player habits, etc.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system (or other electronic device(s)) to perform a process according to embodiments(s), whether presently described or not, because every conceivable variation is not enumerated herein. A machine-readable storage medium includes any mechanism that stores information in a form readable by a machine (e.g., a wagering game machine, computer, etc.). For example, machine-readable storage media includes read only memory (ROM), random access memory (RAM), magnetic disk storage media, optical storage media (e.g., CD-ROM), flash memory machines, erasable programmable memory (e.g., EPROM and EEPROM); etc. Some embodiments of the invention can also include machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating a gaming system configured to combine live video of a casino wagering game with additional content, said method comprising:

receiving a video feed of a casino wagering game presented live via a first device, wherein the video feed depicts at least one first symbol from a set of wagering game symbols used for outcomes of the casino wagering game, wherein at least one portion the video feed lacks presentation of at least one second symbol from the set of wagering game symbols;

after receiving the video feed, compositing, by the gaming system, a computer-generated image with the at least one portion of the video feed to generate a composited video feed, wherein the computer-generated image represents the at least one second symbol from the set of wagering game symbols; and providing the composited video feed for presentation of the casino wagering game via a second device separate from the first device.

2. The method of claim 1, wherein after compositing the computer-generated image with the video feed, the composited video feed depicts both the at least one first symbol and the at least one second symbol, and wherein the at least one first symbol combined with the at least one second symbol depict an outcome of the casino wagering game.

3. The method of claim 1 further comprising:

analyzing the video feed; and determining the at least one second symbol based on the analyzing of the video feed.

4. The method of claim 3, wherein the analyzing the video feed comprises determining that the at least one portion of the video feed lacks the second symbol to complete presentation of an outcome of the casino wagering game.

5. The method of claim 4, wherein the determining that the portion of the video feed lacks the at least one second symbol to complete the presentation of the outcome of the casino wagering game comprises detecting an identifier presented on the video feed that indicates a lack of one of the set of wagering game symbols, and wherein the compositing the computer-generated image with the video feed comprises compositing the computer-generated image at a position on the video feed that coincides with the identifier.

6. The method of claim 3, wherein the analyzing the video feed comprises analyzing activity that occurs in the video feed, and wherein the determining the at least one second symbol based on the analyzing comprises determining the at least one second symbol based on the activity.

7. The method of claim 1 further comprising:

prior to compositing the computer-generated image with the video feed, determining an outcome for the wagering game;

determining that the outcome requires presentation of the at least one second symbol in combination with presentation of the at least one first symbol; and selecting the computer-generated image that represents the at least one second symbol based on the determining that the outcome requires presentation of the at least one second symbol in combination with presentation of the at least one first symbol.

8. The method of claim 1, wherein the compositing the computer-generated image with the video feed comprises one or more of chroma-key compositing the computer-generated image with the video feed and superimposing the computer-generated image over a portion of the video feed.

9. The method of claim 1 further comprising:

selecting the computer-generated image from a group of images customized to a player account associated with the casino wagering game; and using the computer-generated image customized to the player account to represent the at least one second symbol for an outcome of the casino wagering game that includes the at least one second symbol.

10. The method of claim 1, wherein the first device is inside a casino and wherein the second device is outside of the casino.

11. The method of claim 1, wherein the providing the composited video feed for presentation of the casino wagering game via the second device separate from the first device comprises providing the composited video feed to a web server configured to incorporate the video feed into a web page presentable via the second device.

12. A wagering game system comprising:

at least one processor; and at least one non-transitory, machine-readable storage medium configured to store instructions, which when executed by the at least one processor, cause the wagering game system to perform operations for controlling the wagering game system, the instructions including instruction to receive a video feed of the casino wagering game presented live via a first device, wherein the video feed depicts at least one first symbol from a set of wagering game symbols used for the outcomes of the casino wagering game, wherein at least one portion the video feed lacks presentation of at least one second symbol from the set of wagering game symbols, instruction to after receiving the video feed, composite, by the wagering game system, a computer-generated image with the at least one portion of the video feed to generate a composited video feed, wherein the computer-generated image represents the at least one second symbol from the set of wagering game symbols, and instruction to provide the composited video feed for presentation of the casino wagering game via a second device separate from the first device.

13. The wagering game system of claim 12, wherein after the computer-generated image is composited with the video feed, the composited video feed depicts both the at least one first symbol and the at least one second symbol, and wherein the at least one first symbol combined with the at least one second symbol depict an outcome of the casino wagering game.

14. The wagering game system of claim 13, wherein the instructions, when executed by the at least one processor, perform further operations for controlling the wagering game system, the instructions further comprising:

instructions to trigger a secondary wagering game based on the outcome of the casino wagering game; and instructions to composite content for the secondary wagering game into the composited video feed, wherein the content for the secondary wagering game is missing from the live video feed.

15. The wagering game system of claim 12, wherein the instructions further include instructions to:

analyze the video feed;

detect, based on analysis of the video feed, an identifier presented on the video feed that indicates a lack of the at least one second symbol; and composite the computer-generated image at a position on the video feed that coincides with the identifier.

16. The wagering game system of claim 12, wherein the instructions further include instructions to:

analyze activity that occurs in the video feed, and determine the at least one second symbol based on the activity.

17. The wagering game system of claim 12, wherein the instructions, further include instructions to:

select the computer-generated image from a group of images customized to a player account; and use the computer-generated image customized to the player account to represent the at least one second symbol for an outcome of the casino wagering game that includes the at least one second symbol.

18. The wagering game system of claim 12, wherein the first device is inside a casino and wherein the second device is outside of the casino.

19. The wagering game system of claim 12, wherein the instructions further include instructions to:

detect a wager made via the second device for the casino wagering game;

generate a second image that indicates the wager; and composite the second image into the composited video feed.

20. The wagering game system of claim 12, wherein the instructions further include instructions to:

receive a web-cam feed from a participant of the casino wagering game associated with the second device; and composite the web-cam feed into the composited video feed.

21. One or more non-transitory machine-readable storage media having instructions stored thereon which, when executed by a set of one or more processors of a wagering game system, cause the wagering game system to perform operations for controlling the gaming system, the instructions comprising:

instructions for receiving a video feed of a casino wagering game presented live via a first device, wherein the video feed depicts at least one first symbol from a set of wagering game symbols used for outcomes of the casino wagering game, wherein at least one portion the video feed lacks presentation of at least one second symbol from the set of wagering game symbols;

instructions for, after receiving the video feed, compositing, by the gaming system, a computer-generated image with the at least one portion of the video feed to generate a composited video feed, wherein the computer-generated image represents the at least one second symbol from the set of wagering game symbols; and instructions for providing the composited video feed for presentation of the casino wagering game via a second device separate from the first device.

* * * * *